US005933161A

United States Patent [19]

Sato et al.

[11] Patent Number: 5,933,161

[45] Date of Patent: Aug. 3, 1999

[54] INK-JET RECORDER HAVING A DRIVING CIRCUIT FOR DRIVING HEAT-GENERATING ELEMENTS

[75] Inventors: Kunihito Sato; Tohru Mihara; Shinichi Yasunaga; Akira Mihara; Yoshinao Kondoh, all of Ebina, Japan

[73] Assignee: Fuji Xerox Co., Ltd., Tokyo, Japan

[21] Appl. No.: 08/819,270

[22] Filed: Mar. 18, 1997

[30] Foreign Application Priority Data

Mar. 21, 1996 [JP] Japan ..... 8-064440
May 14, 1996 [JP] Japan ..... 8-119059

[51] Int. Cl.[6] ..... B41J 2/05

[52] U.S. Cl. ..... 347/12; 347/60

[58] Field of Search ..... 347/12, 57, 180, 347/181, 182, 13, 60

[56] References Cited

U.S. PATENT DOCUMENTS 5,172,134 12/1992 Kishida ..... 347/13

FOREIGN PATENT DOCUMENTS 678386 4/1995 European Pat. Off. .
A-5-31906 2/1993 Japan .
A-6-79873 3/1994 Japan .
A-6-191039 7/1994 Japan .
A-6-198893 7/1994 Japan .
A-7-76078 3/1995 Japan .
A-7-96607 4/1995 Japan .
A-8-132647 5/1996 Japan .

*Primary Examiner*—Joseph Hartary
*Attorney, Agent, or Firm*—Oliff & Berridge, PLC

[57] ABSTRACT

An ink-jet recorder is disclosed which has an arrangement of a plurality of heat-generating elements, drivers for driving the heat-generating elements, and a drive circuit for controlling the drivers according to image data, wherein the drive circuit includes; a split-block drive circuit that divides the plurality of heat-generating elements into a plurality of blocks, and drives the heat-generating elements on a block-by-block basis in a time-sharing manner, and a data retaining circuit for retaining print data; and the split-block drive circuit that; drives each of the blocks of the heat-generating elements at printing operations, using a pre-pulse during which ink is not squirted and a main pulse during which ink is squirted; and drives another group of heat-generating elements differing from the currently-driven group of heat-generating elements, during intervals between the pre-pulse and the main pulse.

19 Claims, 27 Drawing Sheets

SUBSTRATE
HVDD
MVDD
HEAT-GENERATING ELEMENT
DRIVER
PRE-DRIVER
DOUT2
DOUT1
DTDIR
DCLK
ENABLE
NRST
D1 D2 D3 D4 D5 D6 D7 D8
RE1 RE2 RE3 RE4 CO
DIR
CLR
C Q
NCK
CK
B1 B2 B3 B4 B5 B6 B7 B8
1 2 3 4 5 6 63 64 65 66 255 256
1 2 3 4 5 6 7 8 9 10 12 13 14

FIG. 13
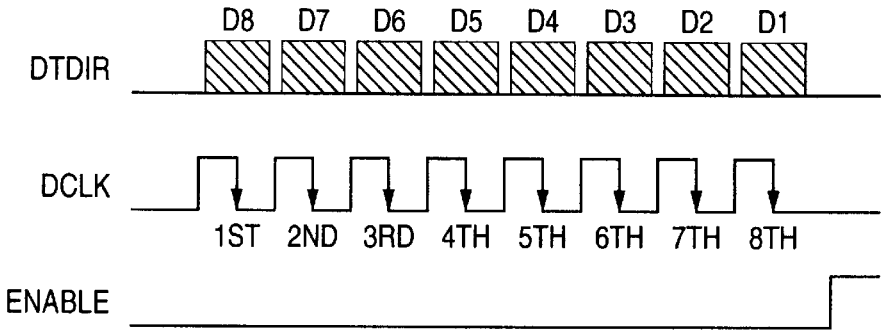
FIG. 14
| DCLK | THE CORRESPONDING HEAT-GENERATING ELEMENT NUMBER (IN CASE OF FORWARD) | THE CORRESPONDING HEAT-GENERATING ELEMENT NUMBER (IN CASE OF REVERSE) |
|---|---|---|
| 1ST ↓ | 1 | 228 |
| 2ND ↓ | 5 | 232 |
| 3RD ↓ | 9 | 236 |
| 4TH ↓ | 13 | 240 |
| 5TH ↓ | 17 | 244 |
| 6TH ↓ | 21 | 248 |
| 7TH ↓ | 25 | 252 |
| 8TH ↓ | 29 | 256 |
FIG. 15
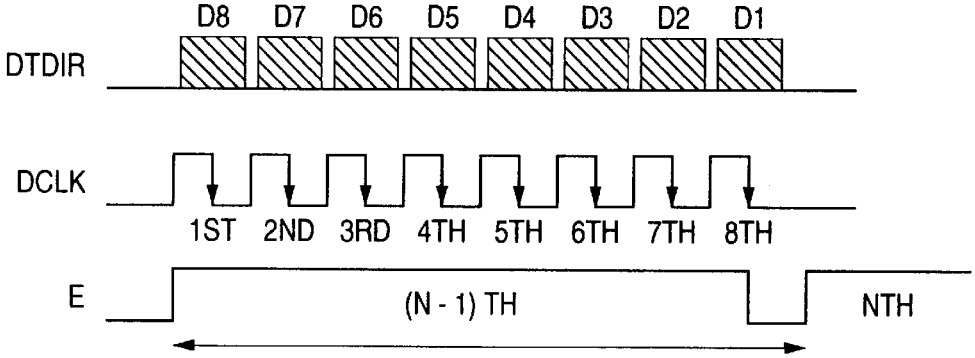

FIG. 16

| DCLK OF (N - 1)TH OF E | THE CORRESPONDING HEAT-GENERATING ELEMENT NUMBER (IN CASE OF FORWARD) | | | |
|---|---|---|---|---|
| | N = 2, 6, 10, · · ·, 30 | N = 3, 7, 11, · · ·, 31 | N = 4, 8, 12, · · ·, 32 | N = 5, 9, · · ·, 29 |
| 1ST ↓ | 8 (N - 2 ) + 3 | 8 (N - 3 ) + 2 | 8 (N - 4 ) + 4 | 8 (N - 1 ) + 1 |
| 2ND ↓ | 8 (N - 2 ) + 7 | 8 (N - 3 ) + 6 | 8 (N - 4 ) + 8 | 8 (N - 1 ) + 5 |
| 3RD ↓ | 8 (N - 2 ) + 11 | 8 (N - 3 ) + 10 | 8 (N - 4 ) + 12 | 8 (N - 1 ) + 9 |
| 4TH ↓ | 8 (N - 2 ) + 15 | 8 (N - 3 ) + 14 | 8 (N - 4 ) + 16 | 8 (N - 1 ) + 13 |
| 5TH ↓ | 8 (N - 2 ) + 19 | 8 (N - 3 ) + 18 | 8 (N - 4 ) + 20 | 8 (N - 1 ) + 17 |
| 6TH ↓ | 8 (N - 2 ) + 23 | 8 (N - 3 ) + 22 | 8 (N - 4 ) + 24 | 8 (N - 1 ) + 21 |
| 7TH ↓ | 8 (N - 2 ) + 27 | 8 (N - 3 ) + 26 | 8 (N - 4 ) + 28 | 8 (N - 1 ) + 25 |
| 8TH ↓ | 8 (N - 2 ) + 31 | 8 (N - 3 ) + 30 | 8 (N - 4 ) + 32 | 8 (N - 1 ) + 29 |

FIG. 17

| DCLK OF (N - 1)TH OF E | THE CORRESPONDING HEAT-GENERATING ELEMENT NUMBER (IN CASE OF REVERSE) | | | |
|---|---|---|---|---|
| | N = 2, 6, 10, · · ·, 30 | N = 3, 7, 11, · · ·, 31 | N = 4, 8, 12, · · ·, 32 | N = 5, 9, · · ·, 29 |
| 1ST ↓ | 242 - 8N | 251 - 8N | 257 - 8N | 236 - 8N |
| 2ND ↓ | 246 - 8N | 255 - 8N | 261 - 8N | 240 - 8N |
| 3RD ↓ | 250 - 8N | 259 - 8N | 265 - 8N | 244 - 8N |
| 4TH ↓ | 254 - 8N | 263 - 8N | 269 - 8N | 248 - 8N |
| 5TH ↓ | 258 - 8N | 267 - 8N | 273 - 8N | 252 - 8N |
| 6TH ↓ | 262 - 8N | 271 - 8N | 277 - 8N | 256 - 8N |
| 7TH ↓ | 266 - 8N | 275 - 8N | 281 - 8N | 260 - 8N |
| 8TH ↓ | 270 - 8N | 279 - 8N | 285 - 8N | 264 - 8N |

FIG. 18
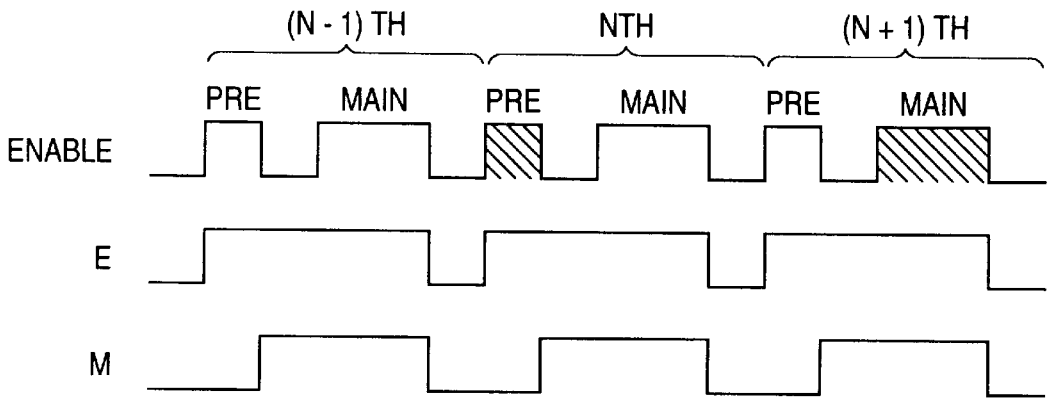
FIG. 19
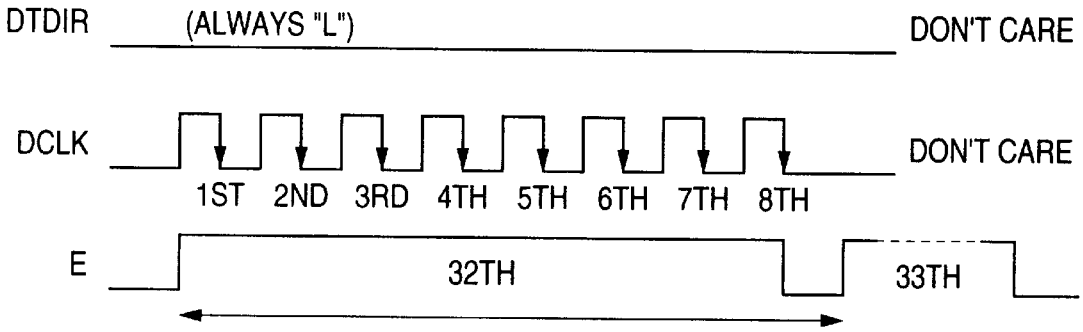
FIG. 20
| E | PRE / MAIN | RE1 | RE2 | RE3 | RE4 |
|---|---|---|---|---|---|
| N = 1, 5, 9, · · · , 33 | PRE | H | | | |
| | MAIN | | | | H |
| N = 2, 6, 10, · · · , 30 | PRE | | H | | |
| | MAIN | H | | | |
| N = 3, 7, 11, · · · , 31 | PRE | | | H | |
| | MAIN | | H | | |
| N = 4, 8, 12, · · · , 32 | PRE | | | | H |
| | MAIN | | | H | |

FIG. 21

| E | PRE / MAIN | B1 | B2 | B3 | B4 | B5 | B6 | B7 | B8 |
|---|---|---|---|---|---|---|---|---|---|
| 1 | PRE | H | | | | | | | |
| | MAIN | | | | | | | | H |
| 2, 3, 4 | PRE | H | | | | | | | |
| | MAIN | H | | | | | | | |
| 5 | PRE | | H | | | | | | |
| | MAIN | H | | | | | | | |
| 6, 7, 8 | PRE | | H | | | | | | |
| | MAIN | | H | | | | | | |
| 9 | PRE | | | H | | | | | |
| | MAIN | | H | | | | | | |
| 10, 11, 12 | PRE | | | H | | | | | |
| | MAIN | | | H | | | | | |
| ⋮ | | | | | | | | | |
| | | | | | | | | | |
| 29 | PRE | | | | | | | | H |
| | MAIN | | | | | | | H | |
| 30, 31, 32 | PRE | | | | | | | | H |
| | MAIN | | | | | | | | H |
| 33 | PRE | H | | | | | | | |
| | MAIN | | | | | | | | H |

FIG. 22

| E | PRE / MAIN | RE1 | RE2 | RE3 | RE4 |
|---|---|---|---|---|---|
| N = 1, 5, 9, · · · , 33 | PRE | | | | H |
| | MAIN | H | | | |
| N = 2, 6, 10, · · · , 30 | PRE | | | H | |
| | MAIN | | | | H |
| N = 3, 7, 11, · · · , 31 | PRE | | H | | |
| | MAIN | | | H | |
| N = 4, 8, 12, · · · , 32 | PRE | H | | | |
| | MAIN | | H | | |

FIG. 23

| E | PRE / MAIN | B1 | B2 | B3 | B4 | B5 | B6 | B7 | B8 |
|---|---|---|---|---|---|---|---|---|---|
| 1 | PRE | | | | | | | | H |
| | MAIN | H | | | | | | | |
| 2, 3, 4 | PRE | | | | | | | | H |
| | MAIN | | | | | | | | H |
| 5 | PRE | | | | | | | H | |
| | MAIN | | | | | | | | H |
| 6, 7, 8 | PRE | | | | | | | H | |
| | MAIN | | | | | | | H | |
| 9 | PRE | | | | | | H | | |
| | MAIN | | | | | | | H | |
| 10, 11, 12 | PRE | | | | | | H | | |
| | MAIN | | | | | | H | | |
| ⋮ | | | | | | | | | |
| | | | | | | | | | |
| 29 | PRE | H | | | | | | | |
| | MAIN | | H | | | | | | |
| 30, 31, 32 | PRE | H | | | | | | | |
| | MAIN | H | | | | | | | |
| 33 | PRE | | | | | | | | H |
| | MAIN | H | | | | | | | |

FIG. 25
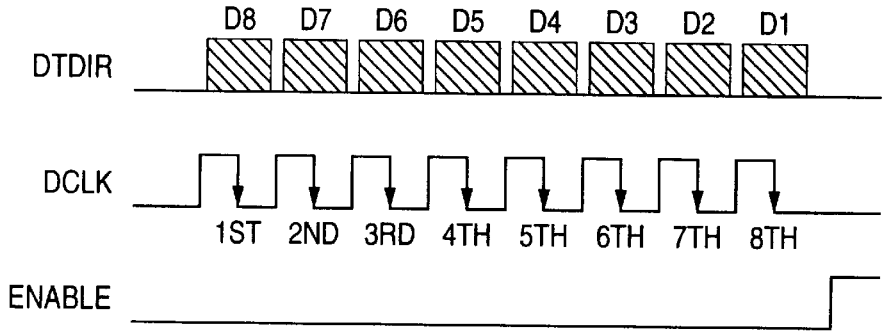
FIG. 26
| DCLK | THE CORRESPONDING HEAT-GENERATING ELEMENT NUMBER (IN CASE OF FORWARD) | THE CORRESPONDING HEAT-GENERATING ELEMENT NUMBER (IN CASE OF REVERSE) |
|---|---|---|
| 1ST ↓ | 1 | 228 |
| 2ND ↓ | 5 | 232 |
| 3RD ↓ | 9 | 236 |
| 4TH ↓ | 13 | 240 |
| 5TH ↓ | 17 | 244 |
| 6TH ↓ | 21 | 248 |
| 7TH ↓ | 25 | 252 |
| 8TH ↓ | 29 | 256 |
FIG. 27
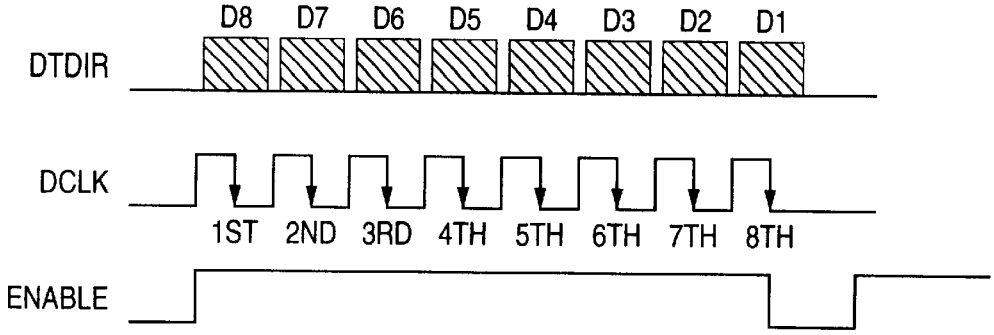

FIG. 28

| NUMBER OF ENABLE | D8 | D7 | D6 | D5 | D4 | D3 | D2 | D1 |
|---|---|---|---|---|---|---|---|---|
| 1 | 1 | 5 | 9 | 13 | 17 | 21 | 25 | 29 |
| 2 | 3 | 7 | 11 | 15 | 19 | 23 | 27 | 31 |
| 3 | 2 | 6 | 10 | 14 | 18 | 22 | 26 | 30 |
| 4 | 4 | 8 | 12 | 16 | 20 | 24 | 28 | 32 |
| 5 | 33 | 37 | 41 | 45 | 49 | 53 | 57 | 61 |
| 6 | 35 | 39 | 43 | 47 | 51 | 55 | 59 | 63 |
| ⋮ | ⋮ | ⋮ | ⋮ | ⋮ | ⋮ | ⋮ | ⋮ | ⋮ |
| 31 | 226 | 230 | 234 | 238 | 242 | 246 | 250 | 254 |
| 32 | 228 | 232 | 236 | 240 | 244 | 248 | 252 | 256 |

FIG. 29

| NUMBER OF ENABLE | D8 | D7 | D6 | D5 | D4 | D3 | D2 | D1 |
|---|---|---|---|---|---|---|---|---|
| 1 | 228 | 232 | 236 | 240 | 244 | 248 | 252 | 256 |
| 2 | 226 | 230 | 234 | 238 | 242 | 246 | 250 | 254 |
| 3 | 227 | 231 | 235 | 239 | 243 | 247 | 251 | 255 |
| 4 | 225 | 229 | 233 | 237 | 241 | 245 | 249 | 253 |
| 5 | 196 | 200 | 204 | 208 | 212 | 216 | 220 | 224 |
| 6 | 194 | 198 | 202 | 206 | 210 | 214 | 218 | 222 |
| ⋮ | ⋮ | ⋮ | ⋮ | ⋮ | ⋮ | ⋮ | ⋮ | ⋮ |
| 31 | 3 | 7 | 11 | 15 | 19 | 23 | 27 | 31 |
| 32 | 1 | 5 | 9 | 13 | 17 | 21 | 25 | 29 |

FIG. 31A

| NUMBER OF ENABLE | RE1 | RE2 | RE3 | RE4 |
|---|---|---|---|---|
| 1 | H | L | L | L |
| 2 | L | H | L | L |
| 3 | L | L | H | L |
| 4 | L | L | L | H |
| 5 | H | L | L | L |
| 6 | L | H | L | L |
| ⋮ | ⋮ | ⋮ | ⋮ | ⋮ |
| 31 | L | L | H | L |
| 32 | L | L | L | H |

FIG. 31B

| NUMBER OF ENABLE | RE1 | RE2 | RE3 | RE4 |
|---|---|---|---|---|
| 1 | L | L | L | H |
| 2 | L | L | H | L |
| 3 | L | H | L | L |
| 4 | H | L | L | L |
| 5 | L | L | L | H |
| 6 | L | L | H | L |
| ⋮ | ⋮ | ⋮ | ⋮ | ⋮ |
| 31 | L | H | L | L |
| 32 | H | L | L | L |

FIG. 32A

| NUMBER OF ENABLE | B1 | B2 | B3 | B4 | B5 | B6 | B7 | B8 |
|---|---|---|---|---|---|---|---|---|
| 1 | H | L | L | L | L | L | L | L |
| 2 | H | L | L | L | L | L | L | L |
| 3 | H | L | L | L | L | L | L | L |
| 4 | H | L | L | L | L | L | L | L |
| 5 | L | H | L | L | L | L | L | L |
| 6 | L | H | L | L | L | L | L | L |
| ⋮ | ⋮ | ⋮ | ⋮ | ⋮ | ⋮ | ⋮ | ⋮ | ⋮ |
| 31 | L | L | L | L | L | L | L | H |
| 32 | L | L | L | L | L | L | L | H |

FIG. 32B

| NUMBER OF ENABLE | B1 | B2 | B3 | B4 | B5 | B6 | B7 | B8 |
|---|---|---|---|---|---|---|---|---|
| 1 | L | L | L | L | L | L | L | H |
| 2 | L | L | L | L | L | L | L | H |
| 3 | L | L | L | L | L | L | L | H |
| 4 | L | L | L | L | L | L | L | H |
| 5 | L | L | L | L | L | L | H | L |
| 6 | L | L | L | L | L | L | H | L |
| ⋮ | ⋮ | ⋮ | ⋮ | ⋮ | ⋮ | ⋮ | ⋮ | ⋮ |
| 31 | H | L | L | L | L | L | L | L |
| 32 | H | L | L | L | L | L | L | L |

INK-JET RECORDER HAVING A DRIVING CIRCUIT FOR DRIVING HEAT-GENERATING ELEMENTS

BACKGROUND OF THE INVENTION

The present invention relates to an ink-jet recorder that produces bubbles in ink retained in a nozzle and squirts the ink by application of energy which heats heat-generating elements provided in the nozzle.

Much attention is now focused on ink-jet recording systems. The ink-jet recording system has a superior balance of recording quality, recording speed, and costs. Further, the ink-jet recording system has several advantages; ease of production of colored prints, capability of recording information on ordinary paper, and its silent operation. There have not been any instances of a continuous recording system, which selectively impacts ink being continuously squirted onto paper, since 1985. Instead of the continuous recording system, a drop-on-demand recording system, which selectively squirts ink, has become dominant. With regard to the drop-on-demand recording system, there are thermal (bubble) recording systems which squirt ink by use of bubbles resulting from rapid heating of ink, and piezoelectric recording systems that squirt ink using ceramics which become deformed upon receiving an applied voltage.

In the case of a thermal ink-jet recording system, through the use of thermal energy the temperature of the recording system increases during recording operations. An increase in the temperature of ink results in a decrease in the viscosity of the ink, so that the amount of ink droplet that is squirted increases. For this reason, variations in the temperature of the recording system result in changes in the amount of ink droplet that is squirted, thereby resulting in deterioration of the print image.

To prevent such a problem, a technique for maintaining a constant amount of ink droplets to be squirted regardless of variations in the temperature of the recording system, is disclosed in the Unexamined Japanese Patent Application Publication No. Hei 5-31906. According to this technique, heat-generating elements are not driven by a single pulse, but by two pulses; namely, a pre-pulse and a main pulse. The width of the pre-pulse is varied according to the temperature of the heat-generating elements. Compared with the case where the heat-generating elements are driven by a single pulse, superior energy efficiency is achieved in the case where the heat-generating elements are driven using double pulses; i.e., a pre-pulse and a main pulse. Further, the volume of foam and squirting speed can be controlled easily by using the double pulses.

As disclosed in; e.g., the Unexamined Japanese Patent Application Publication No. Hei 7-96607, a technique has been recently developed for improving drive frequencies by inserting a pulse for driving another heat-generating element into the interval between the pre-pulse and the main pulse for driving an identical heat-generating element, when the heat-generating element is driven using double pulses. If it is also possible to drive the heat-generating element using a single pulse in the form of an input signal sequence, the print speed can be further increased.

The maximum number of dots which can be simultaneously printed by the thermal ink-jet recording system is determined by several constraints; namely, the capacity of power and a voltage drop due to the resistance of wiring, and interaction occurring between ink pressures. For instance, provided that heat-generating elements which permit passage of an electrical current of about 200 mA is used, an electrical current of more than 1A flows at one time provided that more than five heat-generating elements are driven at the same time. If a large electrical current flows through the center of a board having the heat-generating elements mounted thereon, a voltage drop develops in a common electrode, which adversely affects printing operations. Further, there is a risk of noise mixing into a print head or into a common flexible cable connecting a printer main unit to the print head, as a result of rapid flow of a large electrical current, which in turn adversely affects the printing operations.

In contrast, in order to realize cost reductions and high-density packaging, a method has been proposed wherein a drive circuit for controlling a driver, as well as the driver, are mounted on an identical silicon board having heat-generating elements mounted thereon. As disclosed in; e.g., in the Unexamined Japanese Patent Application Publication No. Hei 7-76078, a recent apparatus has means for driving heat-generating elements, which are divided into groups of a certain number of heat-generating elements, in a time-sharing manner. A block to be driven is designated by a decoder using a decode signal, so that the number of wires is reduced.

To reduce the interaction which occurs between heat-generating elements at the time of ink-squirting operations, a technique has been proposed as disclosed in; e.g., the Unexamined Japanese Patent Application Publication No. Hei 6-191039, in which all the adjoining heat-generating elements are divided into blocks of a certain number of heat-generating elements, and the blocks which are spaced as far away as possible are sequentially driven without driving the adjoining blocks when the blocks of the heat-generating elements are driven in a time-sharing manner. Further, the Unexamined Japanese Patent Application Publication No. Hei 6-198893 discloses a technique in which all of the adjoining heat-generating elements are divided into four blocks every three heat-generating elements, and the thus-divided heat-generating elements are driven in a time-sharing manner. More specifically, according to the technique disclosed in the Unexamined Japanese Patent Application Publication No. Hei 6-191039, the heat-generating elements which are adjoined in each block, and the blocks of the heat-generating elements are discretely driven. In contrast, according to the technique disclosed in the Unexamined Japanese Patent Application Publication No. Hei 6-198893, the heat-generating elements are separately arranged every three elements within each block, and the adjoining blocks of the heat-generating elements are sequentially driven. As described above, techniques regarding drive executed on a block-by-block basis are put forward, as well.

FIG. 34 is a circuit diagram of a substrate having heat-generating elements mounted thereon, for use with one example of conventional ink-jet recorders. In the drawing, reference numeral 1 designates a common electrode; 2 designates heat-generating elements; 3 designates driver elements; 4 designates pre-drivers; 5 designates NAND circuits; 21 designates a 16-bit counter; 22 designates a 64-bit latch; and 23 designates a 64-bit shift register.

In this example, sixty-four heat-generating elements 2 are mounted on the substrate. More precisely, areas for sixty-four heat-generating elements 2 are ensured on the substrate. Therefore, the following cases are implicit in the above-described explanation; namely, where there is ensured only the area at which the heat-generating elements 2 are to be placed, and the heat-generating elements 2 are not actually mounted on that area; where the heat-generating elements have different characteristics and, hence, are not used in ordinary printing operations; and where the heat-generating elements are dummy elements. For example, if a print is produced in several different colors using one substrate, several dummy elements are usually provided between the colors. Based on the previous descriptions, the number of heat-generating elements capable of being provided will be herein referred to as the number of heat-generating elements.

FIG. 34 illustrates a case where sixty-four heat-generating elements are divided into sixteen blocks every four elements and are driven in a separated manner. The sixty-four heat-generating elements are at one end thereof connected to the power source via the common electrode 1, and are at the other end thereof connected to the driver elements 3 respectively. The driver elements 3 can be formed from; e.g., a MOS-FET or a transistor, and drive the heat-generating elements 2. The pre-driver 4 boosts a drive signal for the corresponding heat-generating element 2 and enters the thus-boosted drive signal into the control electrode of the driver element 3; e.g., a gate electrode of a MOS-FET. The NAND circuit 5 receives one split-block drive signal, an ENABLE signal, and a data signal from the 64-bit latch 22. The NAND circuit 5 outputs the drive signal to the pre-driver 4 while the corresponding heat-generating element 2 is selected; while there is data to be printed; and while the NAND circuit 5 has received the ENABLE signal.

The 16-bit counter 21 counts clock pulses and then issues a split-block drive signal. The thus-issued split-block drive signal enters the NAND circuit 5 which corresponds to the block. The 64-bit latch 22 retains print data corresponding to each heat-generating element 2. The 64-bit shift register 23 sequentially retains serially-entered data and transfers the thus-received data to the 64-bit latch 22 in a parallel manner.

In the present example, the 64-bit latch holds 64 items of print data corresponding to the respective heat-generating elements 2. However, for instance, as illustrated in FIG. 5 of the Unexamined Japanese Patent Application Publication No. Hei 6-79873 and in FIG. 5 and others of the Japanese Patent Application No. Hei 6-272375, there is a latch arranged so as to latch only the print data corresponding to one block.

FIG. 35 is a timing chart illustrating one example of operations of the conventional ink-jet recorder. Sixty-four items of print data corresponding to the heat-generating elements 2 previously entered the 64-bit shift register 23 in a serial manner before the first printing operations, are commenced. Subsequently, the 64-bit latch 22 is reset by a DRST signal, and all the print data stored in the 64-bit shift register 23 are transferred to and latched into the 64-bit latch 22 by means of a LCLK signal. The 64-bit latch 22 outputs the thus-received print data to the NAND circuits 5, respectively.

The 16-bit counter 21 is reset by a BRST signal. After the order in which the heat-generating elements are driven has been selected by a BDIR signal, the 16-bit counter 21 counts a BCLK signal and selectively sends the split-block drive signal. According to the timing chart provided in FIG. 35, forward-printing operations are selected when there is a low BDIR signal, whereas reverse-printing operations are selected when there is a high BDIR signal. In response to the first BCLK signal, the 16-bit counter 21 outputs the split-block drive signal, corresponding to the first block, to the first through fourth NAND circuits 5. Of the first through fourth NAND circuits 5, only the NAND circuits 5 that receive print data from the 64-bit latch 22, output a drive signal according to the ENABLE signal, whereby the driver elements 3 are driven via the pre-drivers 4. As a result, of the first through fourth heat-generating elements 2, the heat-generating elements 2 for which there is a print data, permit the flow of an electrical current. Thus, the heat-generating elements 2 are heated. At this time, ink is not squirted during the pre-pulse, only the temperature of the ink is increased as a result of heating operations of the heat-generating elements 2. Bubbles develop in the ink as a result of heating operations of the heat-generating element 2 during the next main pulse, so that ink is squirted and a print is achieved.

The 16-bit counter 21 counts the next BCLK signal and outputs the split-block drive signal corresponding to the second block, to the fifth to eighth NAND circuits 5. Of the fifth through eighth heat-generating elements 2, those heat-generating elements 2 which receive print data, are heated, whence printing operations are carried out. Similarly, blocks of the heat-generating elements are driven in order as far as the 16th block. During the course of drive of the heat-generating elements, the next sixty-four items of print data enter the 64-bit shift register 23.

After drive of the heat-generating elements of the sixteen blocks has been completed, the 16-bit counter 21 is reset by the BRST signal. The direction in which the heat-generating elements are driven is determined by the BDIR signal. In the timing chart provided in FIG. 35, reverse-printing operations are set. The 64-bit latch 22 is reset by the DRST signal, and the print data stored in the 64-bit shift register 23 is latched into the 64-bit latch 22 by an LCLK signal. In the later operations, the heat-generating elements of the blocks are driven in order from the 16th block, and the heat-generating elements of the first block are finally driven. Printing operations are carried out through the repetition of a series of the previously-described operations.

With the foregoing arrangement, if the 16-bit counter 21 is disposed on the substrate having the heat-generating elements 2 mounted thereon, the lateral direction of the substrate is limited as a result of layout of the heat-generating elements 2 which are mounted on top of the substrate. Accordingly, it is necessary to arrange the 16-bit counter 21 in an extremely oblong pattern. Means for driving the heat-generating elements on a block-by-block basis in a time-sharing manner, should preferably have bidirectionality as previously described. Use of; e.g., a binary counter, a Johnson counter, a linear feed-back shift register, or a gray code counter, results in a reduction in the number of gates; however, it is difficult to reduce the area of the layout by routing conductor. For these reasons, it is common to mount the most fundamental counter which uses as many shift registers as there are blocks. In this case, if it is desirable to provide the counter with bidirectionality, it is only necessary to place a selector for reversing the order of shift registers provided before and after the counter, between the shift registers.

In addition to the technique of driving the blocks of the heat-generating elements in a time-sharing manner by utilization of a counter, there is a technique of selecting a block that is driven by decoding a drive signal received from outside of the substrate to a binary code within the substrate. However, the technique of selecting a block that is driven using a binary-decoded signal, requires as many input signal lines for driving purposes as log2 of the number of split blocks. For example, when 25=32 blocks, there are required as many as five input signal lines for block driving purposes.

The number of lines is material in terms of cost and high-density integration of a substrate, and a small circuit scale is desirable in order to reduce the area of a chip and to reduce the heat generated as a result of power consumption.

However, if the number of input signal lines is reduced by sharing functions and address lines with one another, a decoding circuit will become necessary, thereby resulting in a larger circuit size. Further, the speed of print processing will decrease as a result of decoding operations. In the case of double pulse driving operations, or in the case of insertion of a pulse for driving other heat-generating elements during the interval between the pre-pulse and the main pulse, it will become more difficult to reduce the number of wires.

SUMMARY OF THE INVENTION

The present invention has been conceived in view of the foregoing drawbacks in the prior art, and the object of the present invention is to provide an ink-jet recorder in which a reduction in the cost of a substrate and high-density packaging are accomplished by use of a drive circuit suitable for double-pulse drive and by reducing the number of wires.

For example, the ink-jet recording head is particularly effective in enabling flexible change of print order without increasing the area of the substrate and in carrying out discrete printing operations.

According to one aspect of the present invention, there is provided an ink-jet recorder having an arrangement of a plurality of heat-generating elements, drivers for driving the heat-generating elements, and a drive circuit for controlling the drivers according to image data, the improvement being characterized by the fact that the drive circuit has a split-block drive circuit that divides the plurality of heat-generating elements into a plurality of blocks and drives the heat-generating elements on a block-by-block basis in a time-sharing manner; and a data retaining circuit for retaining print data; and the split-block drive circuit that drives each of the blocks of the heat-generating elements at the time of printing operations, using a pre-pulse during which ink is not squirted and a main pulse during which ink is squirted; and that drives another group of heat-generating elements differing from the currently-driven group of heat-generating elements, during intervals between the pre-pulse and the main pulse.

According to a second aspect of the present invention, the ink-jet recorder of the first aspect of the invention is further characterized by the fact that the drive circuit receives four signals from outside of the drive circuit; namely, a print data signal, a clock signal for transferring print data; a drive signal including the pre-pulse and the main pulse; and a reset signal.

According to a third aspect of the present invention, the ink-jet recorder of the second aspect of the invention is further characterized by the fact that the drive circuit alternately receives the pre-pulse and the main pulse as the drive signal, and the pre-pulse and the main pulse which are adjoined, are used for driving another block.

According to a fourth aspect of the present invention, the ink-jet recorder of the second aspect of the invention is further characterized by the fact that the drive circuit receives data for use in switching the order in which the blocks are driven, as the print data signal, while receiving the reset signal.

According to a fifth aspect of the present invention, the ink-jet recorder of the first aspect of the invention is further characterized by the fact that the data retaining circuit retains print data which is twice or less as large as the number of the heat-generating elements included in one block, and switches the retained print data according to whether the heat-generating elements are driven by the drive signal or the main pulse.

According to a sixth aspect of the present invention, the ink-jet recorder of the fifth aspect of the invention is further characterized by the fact that the data retaining circuit has a shift register for sequentially receiving as much print data as the number of heat-generating elements included in one block, a latch circuit for latching the data of the shift register, a delay circuit for delaying the print data by temporarily retaining the print data latched in the latch circuit, and a selection circuit for selecting either the print data latched in the latch circuit or the print data delayed by the delay circuit; and by the fact that the selecting action of the selection circuit is switched according to whether the heat-generating elements are driven by the pre-pulse or the main pulse.

According to a seventh aspect of the present invention, the ink-jet recorder of the first aspect of the invention is further characterized by the fact that the split-block drive circuit has the function of driving the heat-generating elements using a single pulse, and the function of driving the heat-generating elements using two pulses; i.e., the pre-pulse and the main pulse, and the functions are switched by means of an input signal sequence.

According to an eighth aspect of the present invention, the ink-jet recorder of the first aspect of the invention is further characterized by the fact that the split-block drive circuit has bidirectionality with regard to the order in which the blocks are driven.

According to a ninth aspect of the present invention, the ink-jet recorder of the first aspect of the invention is further characterized by the fact that the split-block drive circuit has a plurality of counters which are bidirectional with regard to the order in which the blocks are driven, and one block is selected by outputs of the plurality of counters.

According to a tenth aspect of the present invention, the ink-jet recorder of the first aspect of the invention is further characterized by the fact that the split-block drive circuit has a plurality of counters and specify one block by means of outputs of the counters; that the counter is an asynchronous binary counter which has a plurality of flip-flop circuits, an AND circuit for receiving outputs from the flip-flop circuits and a clock signal delivered to the flip-flop circuits, wherein the output of the AND circuits enters other flip-flop circuits as a clock signal and is connected to the input of another AND circuit; and that a delay time per stage is shorter than a delay time for one flip-flip circuit.

According to an eleventh aspect of the present invention, the ink-jet recorder of the tenth aspect of the invention is further characterized by the fact that the split-block drive circuit has a selection circuit for selecting the outputs and inverted outputs of the flip-flop circuits in the order in which the blocks are driven., so as to enable bidirectional drive of the blocks with regard to the order in which the blocks are driven.

According to a twelfth aspect of the present invention, the ink-jet recorder of the tenth or eleventh aspect of the invention is further characterized by the fact that the split-block drive circuit has a selection circuit that selects one block and drives the thus-selected block using the pre-pulse, and then selects the block which has already been driven by the pre-pulse before the thus-driven block, in order to drive the thus-selected block using the main pulse.

According to a thirteenth aspect of the present invention, the ink-jet recorder of the ninth or tenth aspect of the invention is further characterized by the fact that the split-block drive circuit has arithmetic logic circuits which receive one output of the plurality of counters and one output line from the data retaining circuit, so as to respectively correspond to the heat-generating elements, and the driver of the corresponding heat-generating element is driven by using the output from the arithmetic logic circuit.

According to a fourteenth aspect of the present invention, the ink-jet recorder of the first aspect of the invention is further characterized by the fact that a pre-driver section for synthetically boosting the output of a low-voltage logic element provided in the drive circuit, and a regulator for supplying power to the pre-driver section, are interposed between the drivers and the drive circuit; and that the regulator circuit feeds power to the pre-driver section from the common electrode for use with the heat-generating elements and has a standby mode in which power is not supplied to the pre-driver in response to the input signal.

According to a fifteenth aspect of the present invention, the ink-jet recorder of the first aspect of the invention is further characterized by the fact that the heat-generating elements are formed from polysilicon, and the driver is formed from a MOS transistor.

According to a sixteenth aspect of the present invention, the ink-jet recorder of the first aspect of the invention is further characterized by comprising a first test terminal, for outputting a part of a block selection signal output from the split-block drive circuit, and a second test terminal, which outputs at least a part of data signal output from the data retaining circuit.

According to a seventeenth aspect of the present invention, there is provided an ink-jet recording head which includes a substrate having mounted thereon; a plurality of heat-generating elements for applying thermal energy to ink, a driver for driving the heat-generating elements, and a drive circuit for controlling the driver according to image data, the improvement being characterized by comprising a split-block drive circuits that divides the plurality of heat-generating elements into a plurality of blocks and drives the heat-generating elements on a block-by-block basis in a time-sharing manner; a data retaining circuit for retaining print data; and input lines which correspond to the plurality of heat-generating elements and are routed on the substrate so as to cross at least one of block drive lines of the split-block driving circuit, so that the block drive line and the input lines are connected together through an intersection between them.

According to an eighteenth aspect of the present invention, the ink-jet recording head as defined in the seventeenth aspect of the present invention is further characterized by the fact that the quotient resulting from division of the number of all the heat-generating elements provided on the substrate by the maximum number of characters capable of being simultaneously printed, can be solved into factors.

BRIEF DESCRIPTION OF THE DRAWINGS

FIG. 13 is a timing chart used when print data regarding the first block are read at the time of double pulse driving operations;

FIG. 14 is a table illustrating the heat-generating element numbers corresponding to the print data which are read for the first block at the time of double pulse driving operations;

FIG. 15 is a timing chart used when print data regarding the Nth block is read at the time of double pulse driving operations;

FIG. 16 is a table illustrating the heat-generating element numbers corresponding to the print data which are read for the Nth block when the blocks are driven in a forward direction, at the time of double pulse driving operations;

FIG. 17 is a table illustrating the heat-generating element numbers corresponding to the print data which are read for the Nth block when the blocks are driven in a reverse direction, at the time of double pulse driving operations;

FIG. 18 is a timing chart regarding the timing between the driving operations caused by the pre-pulse and the driving operations caused by the main pulse in an identical block at the time of double pulse driving operations;

FIG. 19 is a timing chart used when the print data contained in the 32nd segment of a signal E are read at the time of double pulse driving operations;

FIG. 20 is a table illustrating one example of the operations of the 4-bit ring counter carried out when the blocks are driven in a forward direction as a result of double pulse driving operations;

FIG. 21 is a table illustrating one example of the operations of the 8-bit ring counter carried out when the blocks are driven in a forward direction as a result of double pulse driving operations;

FIG. 22 is a table illustrating one example of operations of the 4-bit ring counter 7 carried out when the blocks are driven in a reverse direction as a result of double pulse driving operations;

FIG. 23 is a table illustrating one example of the operations of the 8-bit ring counter carried out when the blocks are driven in a reverse direction as a result of double pulse driving operations;

FIG. 25 is a timing chart used when the print data regarding the first block is read at the time of the single pulse driving operations;

FIG. 26 is a table illustrating the heat-generating element numbers corresponding to the print data which are read for the first block at the time of single pulse driving operations;

FIG. 27 is a timing chart used when the print data regarding the Nth block is read at time of single pulse driving operations;

FIG. 28 is a table illustrating the heat-generating element numbers corresponding to the print data which are read for the Nth block when the blocks are driven in a forward direction, at the time of single pulse driving operations;

FIG. 29 is a table illustrating the heat-generating element numbers corresponding to the print data which are read for the Nth block when the blocks are driven in a reverse direction, at the time of single pulse driving operations;

FIGS. 31A and 31B are tables illustrating one example of operations of the 4-bit ring counter carried out at the time of single pulse driving operations;

FIGS. 32A and 32B are tables illustrating one example of operations of the 8-bit ring counter carried out at the time of single pulse driving operations;

DETAILED DESCRIPTION OF THE PREFERRED EMBODIMENTS

Figure 1:
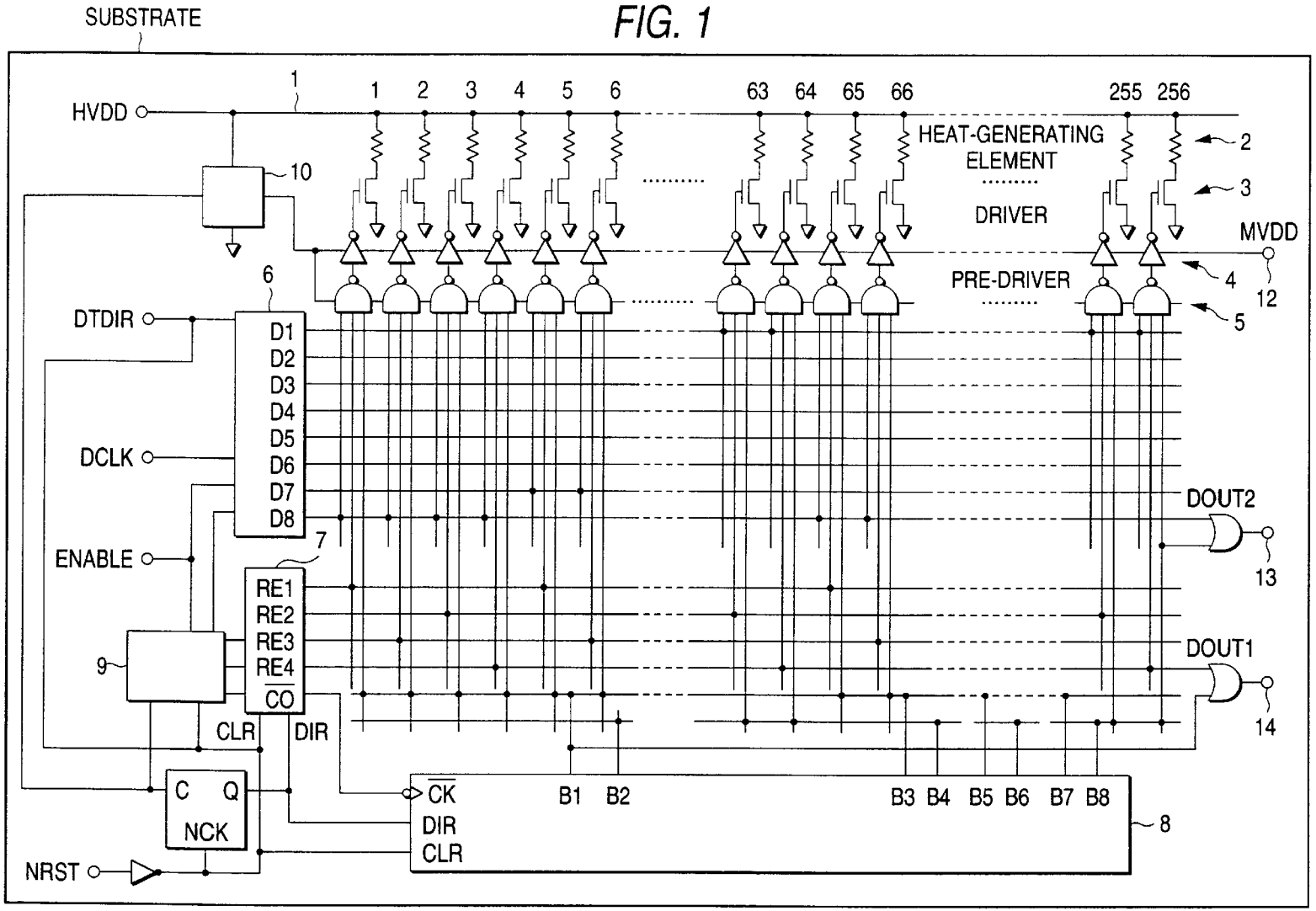
FIG. 1 is a circuit diagram illustrating one example of configuration of a circuit formed on a substrate having heat-generating elements mounted thereon, according to one embodiment of an ink-jet recorder of the present invention.
Figure 34:
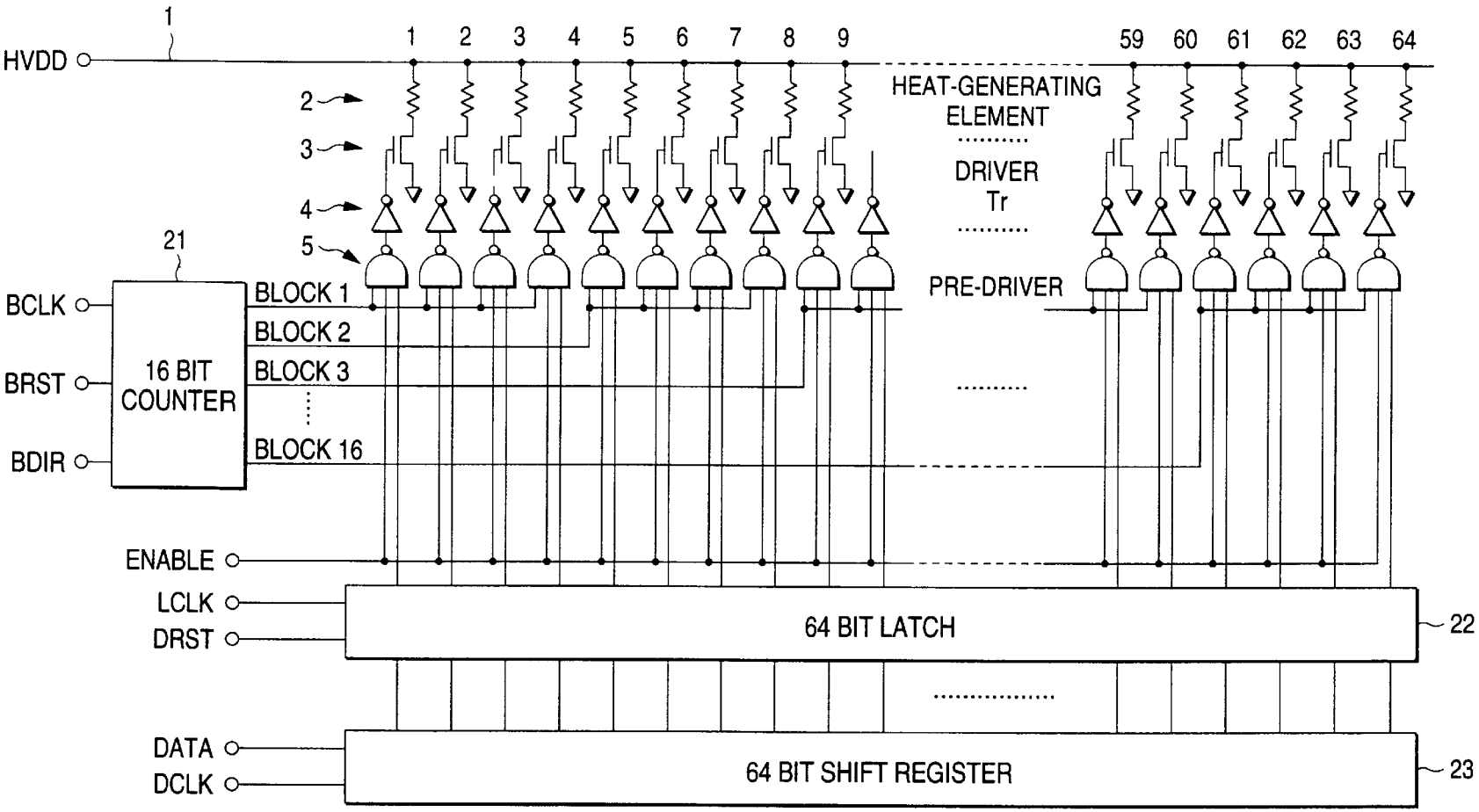
FIG. 34 PRIOR ART
FIG. 34 is a circuit diagram of a substrate having heat-generating elements mounted thereon, for use with one example of conventional ink-jet recorders.
Figure 35:
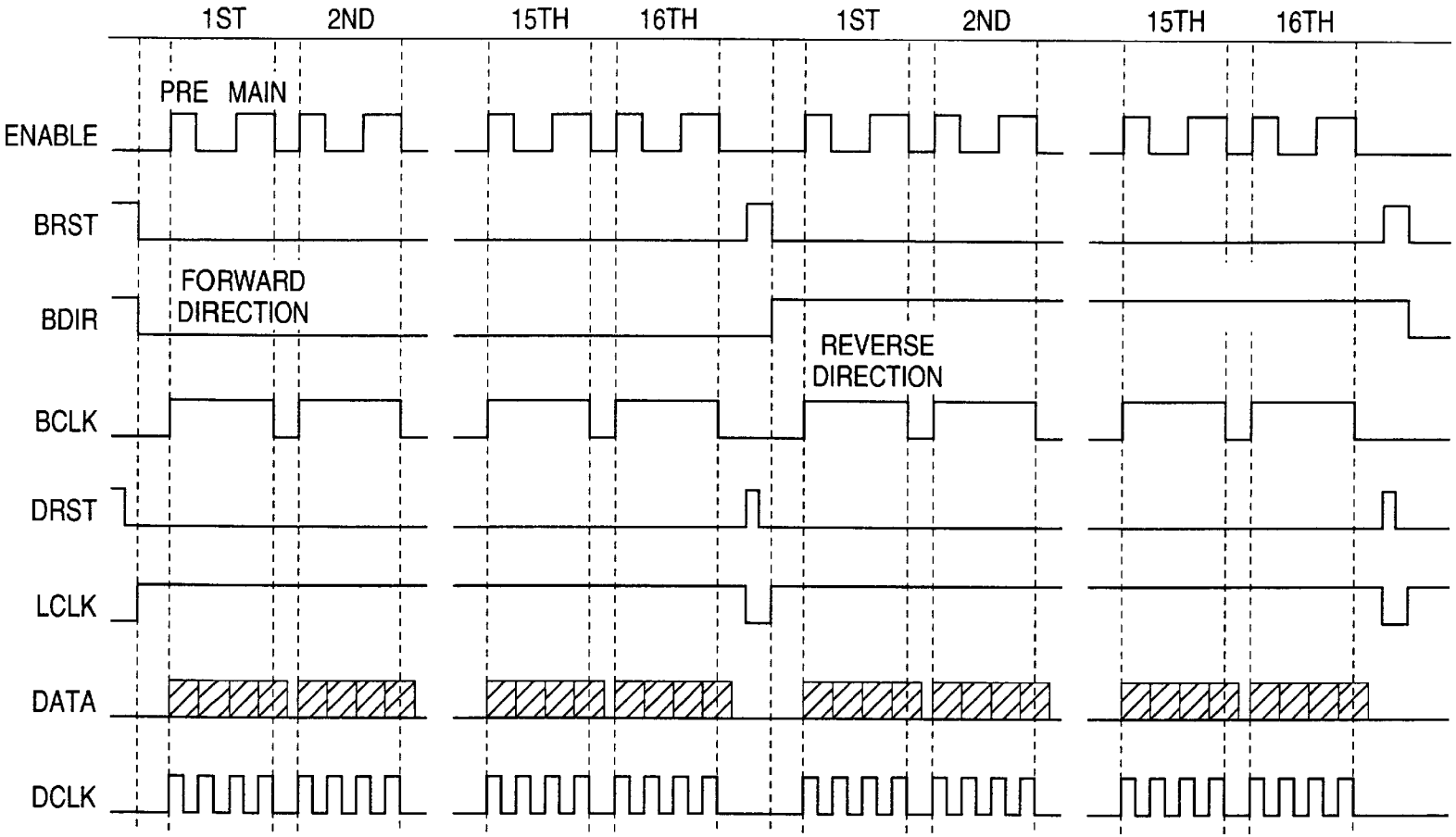
FIG. 35 PRIOR ART
FIG. 35 is a timing chart illustrating one example of operations of the conventional ink-jet recorder.

FIG. 1 is a circuit diagram illustrating one example of configuration of a circuit formed on a substrate having heat-generating elements mounted thereon, according to one embodiment of an ink-jet recorder of the present invention. In the drawing, the elements that are the same as those provided in FIG. 34 are assigned the same reference numerals. Reference numeral 6 designates a data retaining circuit; 7 designates a 4-bit ring counter; 8 designates an 8-bit ring counter; 9 designates a clock generation circuit; 10 designates a regulator; 11 designates a D-latch; 12 designates a pre-driver power voltage monitoring terminal; and 13 and 14 designate test signal output terminals. FIG. 1 and the other accompanying drawings are all conceptual diagrams without any consideration of fan-out and the capacity of wires, and detailed portions of the circuit; e.g., buffers, are omitted.

FIG. 1 shows one example of configuration of the circuit having 256 heat-generating elements 2. These heat-generating elements 2 are divided into 32 groups, and the groups of the heat-generating elements 2 are driven in a time-dividing manner. Each group is comprised of the heat-generating elements 2 discretely arranged every fourth number. For example, the first group is comprised of 1st, 5th, 9th, 13th, 17th, 21st, 25th, and 29th heat-generating elements 2. The heat-generating elements 2 can be arranged at a resolution of; e.g., 600 dots/25.4 mm.

The overall circuit is comprised of the 256 heat-generating elements 2, drivers (high-withstand-voltage transistors) 3 which heat the heat-generating elements 2 by supplying an electrical current to them, and a drive circuit for controlling the drivers. The heat-generating element 2 can be formed from a polysilicon layer having a sheet resistance of about 40 to 60 ohms. An HVDD voltage applied to the common electrode 1 is; e.g., about 36 to 40 volts.

The drive circuit has the function of controlling a print current flowing to each of the heat-generating elements 2 by means of print data serially received from outside of the circuit. The representative function of the heat-generating element 2 is a pre-heating function. This pre-heating function operates by previously heating the heat-generating elements which perform printing operations by supplying an electrical current to the heat-generating elements for a small period of time using the pre-pulse. This function will be hereinafter referred to a pre-pulse function.

Figure 2:
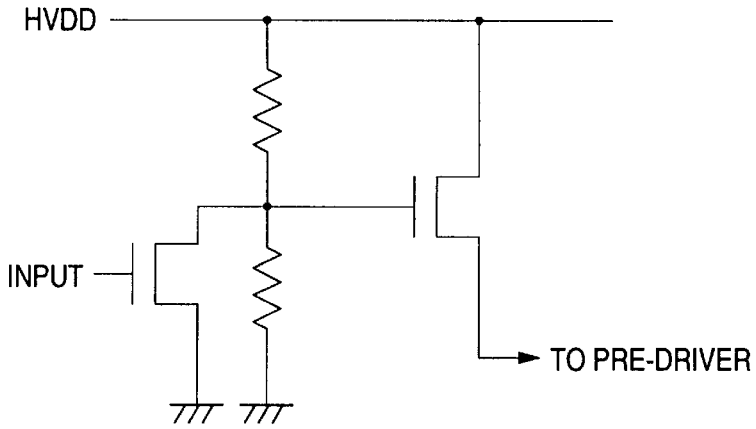
FIG. 2 is a circuit diagram illustrating one example of a regulator.

The drive circuit that controls the drivers 3 is made up of a low-voltage logic section, and pre-drivers 4 which act as interfaces between the drivers 3 and the low-voltage logic section. In the example illustrated in FIG. 1, the drivers 3 are made up of MOS transistors. To sufficiently turn the MOS transistors on, the power source for use with the pre-drivers 4 is set to 10 to 15 volts. The pre-drivers 4 synthetically boost the output of the low-voltage logic section, whereby the drivers 3 are driven. The power source for use with the pre-drivers are supplied from the regulator 10. FIG. 2 is a circuit diagram illustrating one example of the regulator. The circuit of the regulator illustrated in FIG. 2 is a popular circuit. Two resistors are connected in series between the power source and a ground. A divided voltage is connected to the gate of a FET, and the output of the FET is used as the power source for use with the pre-drivers. Another FET is connected in parallel with the resistors connected to the ground. An inverted NRST signal enters the gate of that FET, whereby the power source can be controlled according to the NRST signal. As a result, a standby mode in which the power is not supplied the pre-drivers 4 can be accomplished. If a bipolar transistor is used as the drivers 3, it will be possible to configure the circuit without use of the pre-drivers 4 and the regulator 10 because the bipolar transistor does not need to be boosted.

Figure 3:
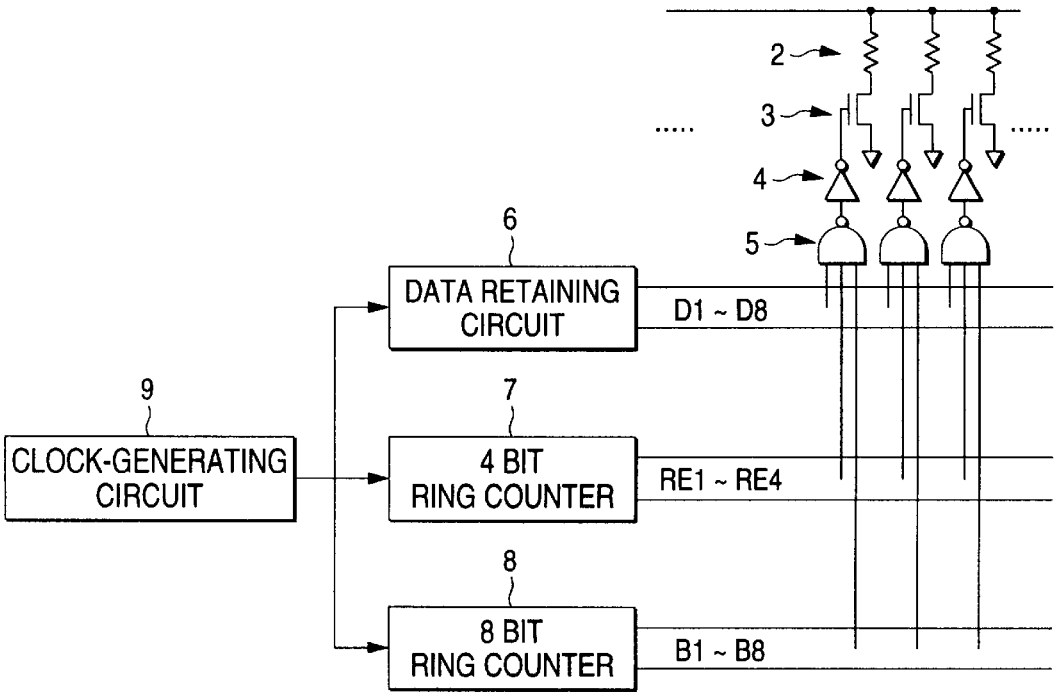
FIG. 3 is a schematic diagram illustrating one example of a low-voltage logic section.

The low-voltage logic section is comprised of the NAND circuits 5 provided so as to correspond to the heat-generating elements 2, the data retaining circuit 6, the 4-bit rink counter 7, the 8-bit ring counter 8, the clock-generating circuit 9, and the D-latch 11. FIG. 3 is a schematic diagram illustrating one example of the low-voltage logic section. The data retaining circuit 6 outputs print data according to a signal generated by the clock generation circuit 9. The 4-bit ring counter 7 and the 8-bit ring counter 8 respectively output the split-block drive signal for selecting the blocks that are driven, according to the signal generated by the clock generation circuit 9. The NAND circuits 5 fetch one split-block drive signal and one print data from the split-block drive signals and the print data of the counters. An logical AND result of the print data and the split-block drive signal is output to the pr-drivers 5 as a drive signal.

The data retaining circuit 6 retains the print data corresponding to two blocks. The print data is output in a switchable manner according to whether the pulse is the pre-pulse or the main pulse. The data retaining circuit 6 receives the print data as a DTDIR signal and a DCLK signal as the clock signal. The print data is switched by an ENABLE signal consisting of the pre-pulse signal and the main pulse signal. The print data used with the pre-pulse signal is transferred so as to be used with the main pulse according to the signal received from the clock generation circuit 9.

The 4-bit ring counter 7, in principle, performs shift operations using the ENABLE signal as the clock signal. The 8-bit ring counter 8 performs shift operations using an execution signal of the 4-bit ring counter 7 as the clock signal. The 8-bit ring counter 8 selects any four blocks from the 32 blocks, and the 4-bit ring counter selects one block from the thus-selected four blocks. If a pulse for another block is inserted between the pre-pulse and main pulse for certain blocks, a block which is driven by the pre-pulse will be different from a block which is driven by the main pulse following the pre-pulse. Because of this, the data retaining circuit 6 receives a signal for switching between the pre-pulse and the main pulse from the clock generation circuit 9 together with the clock signal for counting purposes. The order in which the blocks are selected, is determined by the DTDIR signal, and the selecting order is set according to the NRST signal that is a rest signal. The NRST signal is further used in resetting the 4-bit ring counter 7 and the 8-bit ring counter 8. Binary counters which are field counters can be used as the 4-bit counter 7 and the 8-bit counter 8 in order to reduce the circuit to as small a size as possible.

The clock generation circuit 9 generates a pre-pulse/main pulse switch signal and the clock signals corresponding to one pair of the pre-pulse signal and the main pulse signal, from the ENABLE signal. The thus-generated signals are output together with the ENABLE signal. The clock generation circuit 9 also determines whether the current driving mode is a single pulse drive or a double pulse drive using the NRST and DTDIR signals, whereby a resultantly produced signal corresponds to the drive method used in determining the signal. The D-latch 11 latches the DTDIR signal according to the NRST signal and outputs a DIR signal that is a signal for switching the order in which the blocks are driven.

The signals will be described respectively. The input signals are comprised of only four signals; namely, the NRST signal, the ENABLE signal, the DTDIR signal, and the DCLK signal. The NRST signal is a clear signal only for resetting purposes, and the 4-bit ring counter 7 and the 8-bit ring counter 8 are reset when the NRST signal is low. Further, when the NRST signal is low, the regulator 10 enters a less power-consumption mode in which the regulator 10 does not supply any power to the pre-drivers 4. The order in which the blocks are driven is set on the leading edge of the NRST signal, whereas the single pulse driver or the double pulse drive is selected on the trailing edge of the NRST signal.

When being high, the ENABLE signal turns the drivers 3 on. When the double pulse drive is carried out, the pre-pulse and the main pulse alternately appear on a waveform. The data retaining circuit 6 latches the print data on the leading edge of the pre-pulse and shifts the 4-bit ring counter 7 on the trailing edge of the main pulse.

Figure 4A:
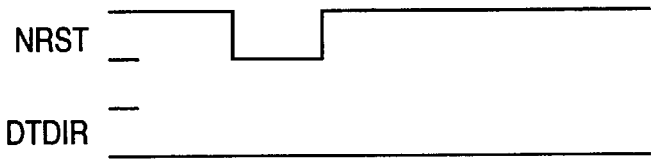
FIGS. 4A to 4D are timing charts illustrating one example of a pre-pulse function and selection of a driving order which use a DTDIR signal.
Figure 4B:
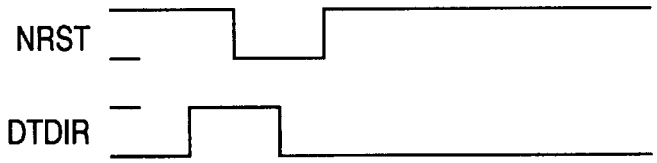

As the DTDIR signal, the signal used for selecting the order in which the blocks are driven, and the single pulse/double pulse drive selection signal are received together with the serial print data. FIGS. 4A to 4D are timing charts illustrating one example of the pre-pulse function and selection of a driving order which use the DTDIR signal. Either the single pulse drive or the double pulse drive is selected according to the DTDIR signal on the trailing edge of the NRST signal. As illustrated in FIG. 4A, the double pulse drive is set when the DTDIR signal is low on the trailing edge of the NRST signal. Further, as illustrated in FIG. 4B, the single pulse drive is set when the DTDIR signal is high. These settings are made by the clock generation circuit 9.

Figure 4C:
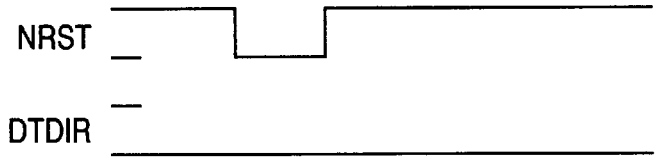
Figure 4D:
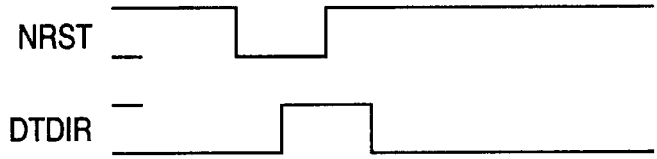

The order in which the blocks are driven, is determined by the DTDIR signal on the leading edge of the NRST signal. As illustrated in FIG. 4C, a forward direction is set when the DTDIR signal is low on the leading edge of the NRST signal. In contrast, as illustrated in FIG. 4D, a reverse direction is set when the DTDIR signal is high on the leading edge of the NRST signal. These settings are carried out by the D-latch 11. More specifically, the D-latch 11 latches the DTDIR signal on the trailing edge of the inverted NRST signal. The thus-latched DTDIR signal enters the 4-bit ring counter 7 and the 8-bit ring counter 8 as the DIR signal designating the order in which the blocks are driven.

The DCLK signal is a clock signal of serial print data. The data retaining circuit 6 fetches the print data on the trailing edge of the clock signal.

An MVDD signal is output from the pre-driver power voltage monitoring terminal 12. The MVDD signal is an output to monitor the voltage of the pre-driver power source for use with the pre-drivers 4. Further, the test signal output terminals 13 and 14 output DOUT 1 and DOUT 2 signals which are test signals output from internal logic circuits. In the example illustrated in FIG. 1, an exclusive OR result of one output from the 4-bit ring counter 7 and one output from the 8-bit ring counter 8, is output as the DOUT 1 signal. Further, an exclusive OR result of one output from the 8-bit ring counter 8 and one output from the data retaining circuit 6, is output as the DOUT 2 signal.

Figure 5:
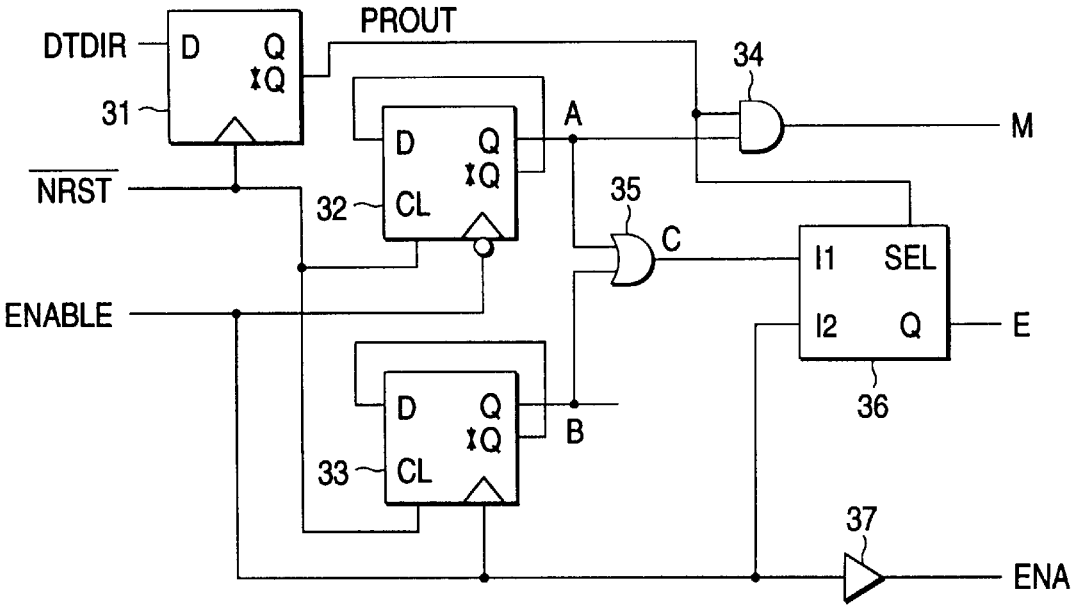
FIG. 5 is a circuit diagram illustrating one example of a clock generation circuit.

FIG. 5 is a circuit diagram illustrating one example of the clock generation circuit. In the drawing, reference numerals 31 to 33 designate D flip-flop; 34 designates an AND circuit; 35 designates an OR circuit; 36 designates a selector; and 37 designates a delay circuit. The D flip-flop 31 latches the DTDIR signal on the leading edge of the inverted NRST signal and supplies the thus-latched DTDIR signal to the AND circuit 34 and the selector 36 as a select signal. As previously described, it is determined on the trailing edge of the NRST signal whether to carry out the single pulse drive or the double pulse drive. Therefore, the DTDIR signal detected on the leading edge of the inverted NRST signal designates a double pulse drive when it is low, but designates a single pulse drive when it is high. Since the inverted DTDIR signal is used in the present embodiment, the inverted DTDIR signal is high when the double pulse drive is carried out and is low when the single pulse drive is carried out.

The D flip-flop 32 outputs signal A by inverting the result of output of logic operations on the trailing edge of the ENABLE signal. In short, the D flip-flop 32 becomes high on the first trailing edge of the ENABLE signal and becomes low on the second trailing edge of the same. The AND circuit 34 outputs an output of the D flip-flop 32 as signal M only when the output of the D flip-flop 31 is high.

The D flip-flop 33 outputs signal B by inverting the result of output of logic operations on the leading edge of the ENABLE signal. In short, the D flip-flop 33 becomes high on the first trailing edge of the ENABLE signal and becomes low on the second trailing edge of the same. The OR circuit 35 outputs an exclusive OR result of the outputs of the D flip-flop 32 and the D flip-flop 33; namely, an exclusive OR result of the signals A and B, as signal C. Even in the case of a double pulse drive, the signal C has a width which includes one set of the pre-pulse and the main pulse.

The selector 36 switches between the signal C output from the OR circuit 35 and the ENABLE signal according to the output of the D flip-flop 31, whereby signal E is output. When the double pulse drive is carried out, a high signal enters a SEL terminal. Hence, at this time, the signal C that is an output of the OR circuit 35 is selected. In contrast, when the single pulse drive is carried out, the ENABLE signal is selected. The ENABLE signal is subjected to timing control by the delay circuit 37, so that the thus-controlled signal is output as an ENA signal.

The M signal, E signal, and the ENA signal are supplied to the data retaining circuit 6 and the 4-bit ring counter 7.

Figure 6:
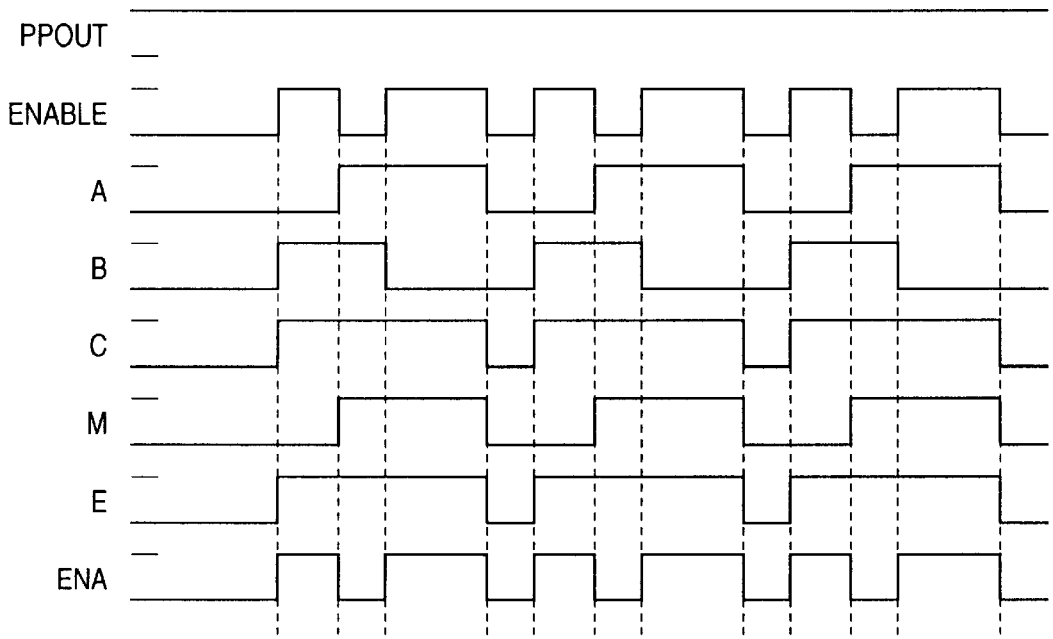
FIG. 6 is a timing chart illustrating one example of signals generated at the time of double pulse driving operations.

FIG. 6 is a timing chart illustrating one example of signals generated at the time of double pulse driving operations. When the double pulse driving operations are carried out, an output (PPOUT) of the D flip-flop 31 becomes high. Then, a signal including the pre-pulse and the main pulse are input as the ENABLE signal. The signal A output from the D flip-flop 32 becomes high on the trailing edge of the pre-pulse and becomes low on the trailing edge of the main pulse. The signal B output from the D flip-flop 33 becomes high on the leading edge of the pre-pulse and becomes low on the leading edge of the main pulse. The OR circuit 35 produces an exclusive OR result of the signals A and B. The OR circuit 35 outputs signal C which becomes high on the leading edge of the pre-pulse and becomes low on the trailing edge of the main pulse. Further, the signal A is directly output from the AND circuit 34 as signal M. Since a high signal enters the SEL terminal, the selector 36 selects the signal C and outputs the thus-selected signal as signal E.

Figure 7:
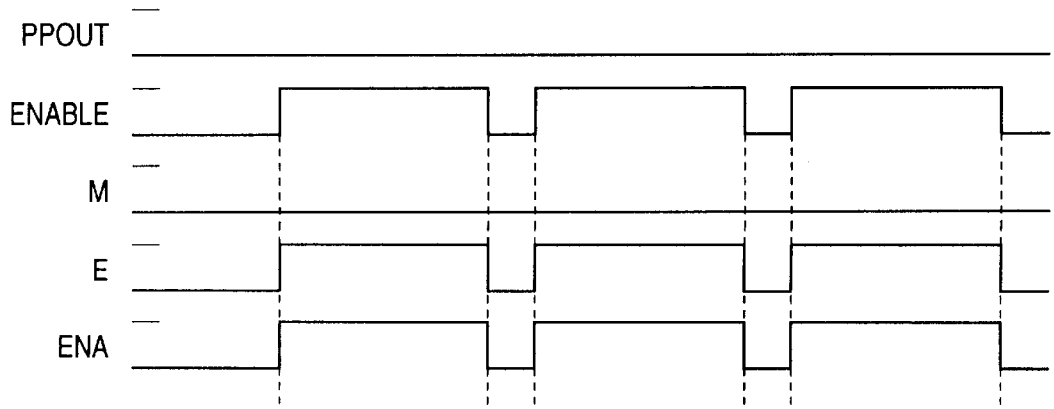
FIG. 7 is a timing chart illustrating one example of the signals generated at the time of single pulse driving operations.

FIG. 7 is a timing chart illustrating one example of the signals generated at the time of single pulse driving operations. In this case, a single drive pulse is input as the ENABLE signal. When single pulse driving operations are carried out, the output (PPOUT) of the D flip-flop 31 becomes low, and the signal M output from the AND circuit 34 remains low. Further, the selector 36 selects the ENABLE signal and outputs the thus-selected signal as the signal E.

Figure 8:
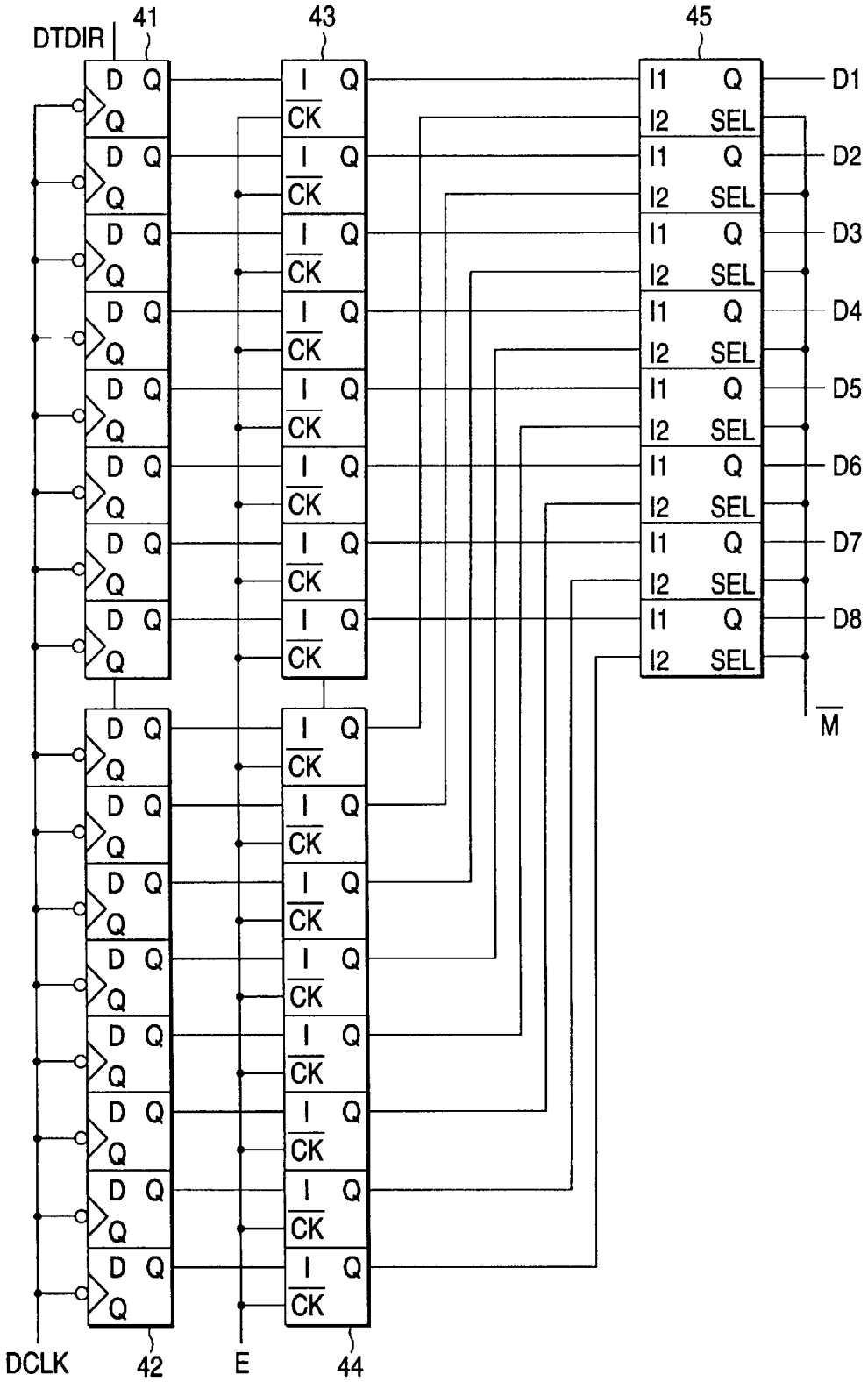
FIG. 8 is a circuit diagram illustrating one example of a data retaining circuit.

FIG. 8 is a circuit diagram illustrating one example of the data retaining circuit. In the drawing, reference numerals 41 and 42 designate shift registers; 43 and 44 designate latches; and 45 designates selectors. The shift registers 41 and 42 are configured so as to be able to retain 8 bits of print data and sequentially carry out shifting operations according to the DCLK signal. The shift registers 41 read the print data for use with the pre-pulse every 8 bits. When reading the print data for use with the next pre-pulse, the shift registers 41 send 8 bits of the print data retained therein to the subsequent shift registers 42 as the data for use with the main pulse. The shift registers 42 receive the print data for use with the main pulse from the shift registers 41. Each of the latches 43 and 44 retains 8 bits of print data. The latches 43 are for use with the pre-pulse and latch the contents retained in the shift registers 41 according to the signal E output from the clock generation circuit 9. In contrast, the latches 44 are for use with the main pulse and latch the contents retained in the shift registers 42 according to the signal E in the same way as does the latches 43. During the course of reading of 8 bits of print data for use with the pre-pulse, the print data for use with the pre-pulse remains in the next shift register as the data for the main pulse when the print data for use with the next pre-pulse is read, which makes it possible to easily control the pulse for use with another block inserted between the pre-pulse and the main pulse.

The selectors 45 select the latches 43 by means of the signal obtained as a result of reversal of the signal M output from the clock generation circuit 9, when the SEL terminal is high. When the SEL terminal is low, the selectors 45 select the latches 44 and output the contents of the thus-selected latches. When the double pulse driving operations are carried out, the signal M becomes low at the time of the pre-pulse and becomes high at the time of the main pulse. For these reasons, the selectors 45 select the contents of the latches 43 at the time of the pre-pulse and select the contents of the latches 44 at the time of the main pulse. When the single pulse driving operations are carried out, the signal M constantly remains low, and hence the latches 43 are selected.

Figure 9:
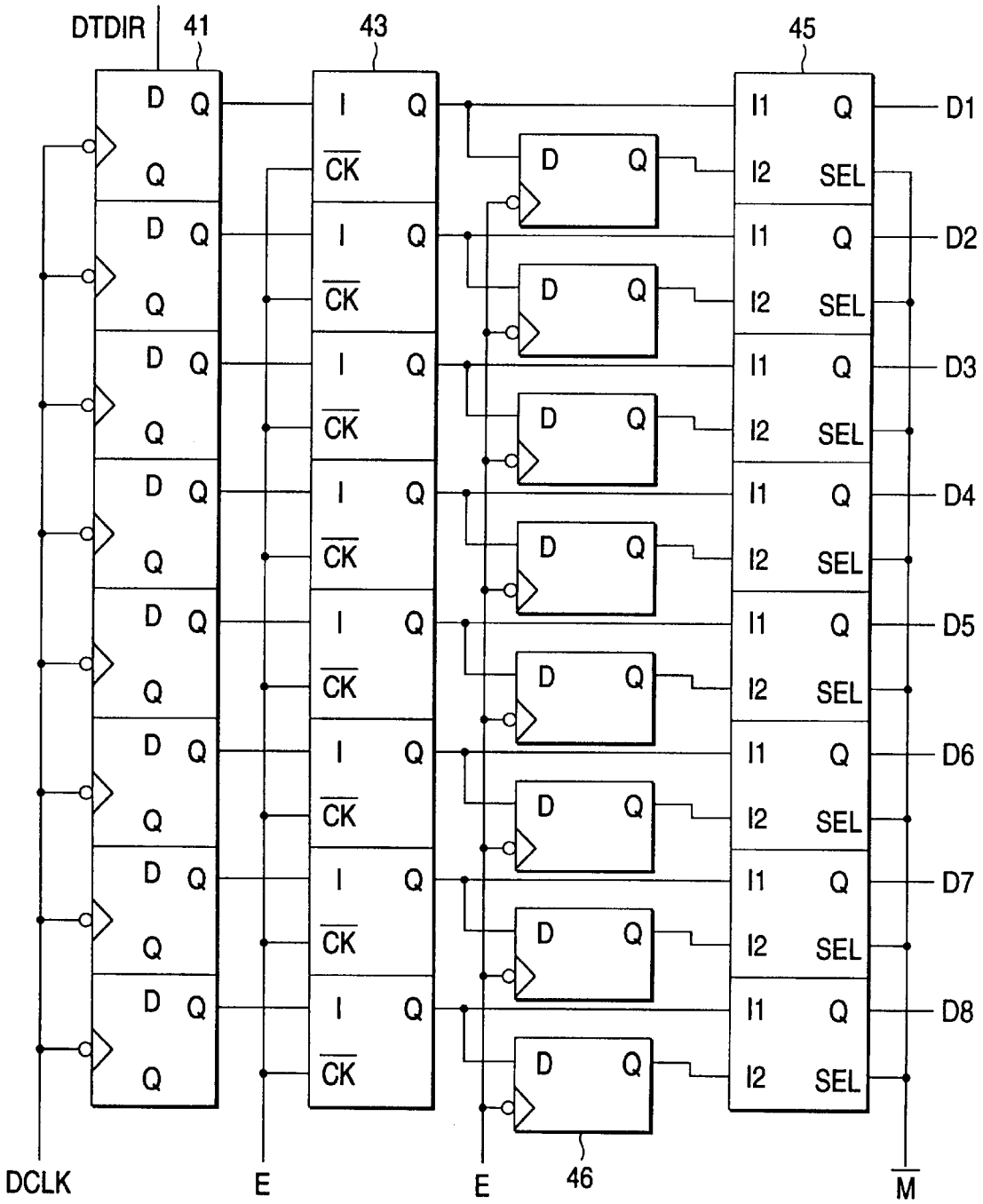
FIG. 9 is a circuit diagram illustrating another example of the data retaining circuit.

FIG. 9 is a circuit diagram illustrating another example of the data retaining circuit. In the drawing, the elements that are the same as those provided in FIG. 8 are assigned the same reference numerals, and their explanations will be omitted here. Reference numeral 46 designates D flip-flops, and the shift registers are provided in a single stage. The latches 43 latch 8 bits of print data taken into the shift registers 41 when the signal E is high. Subsequently, the D flip-flops 46 latch the outputs of the latches 43 on the trailing edge of the signal E. As a result, the print data for use with the main pulse is retained in the D flip-flops 46 in the same way as does the shift registers 42 provided in FIG. 8. The outputs of the D flip-flops 46 are reset to low by the NRST signal. The selectors 45 select the outputs of the latches 43 or of the D flip-flops 46 according to the inverted signal M. At the time of the pre-pulse, the latches 43 are selected, and their contents are output. Subsequently, the D flip-flops 46 are selected, and their contents are output. Then, the signal E falls, and hence the print data retained in the latches 43 are transferred to the D flip-flops 46. Next, the signal E rises to a high, the latches 43 receive and latch new print data from the shift registers 41, and the thus-received print data are output from the selectors 45. Subsequently, the print data that have previously been latched into the D flip-flops 46 are output.

With the circuit configuration as provided in FIG. 9, a fewer number of latches and a smaller amount of conductor routing are required when compared with those used in the circuit configuration provided in FIG. 8. Therefore, the circuit configuration provided in FIG. 9 is more advantageous than the circuit configuration provided in FIG. 8.

One example of the 4-bit ring counter and the 8-bit ring counter will now be described. The 4-bit ring counter 7 performs shifting operations according to the ENA signal output from the clock generation circuit 9, and the 8-bit ring counter 8 operates using the execution signal output from the 4-bit ring counter 7 as a clock signal.

Figure 10:
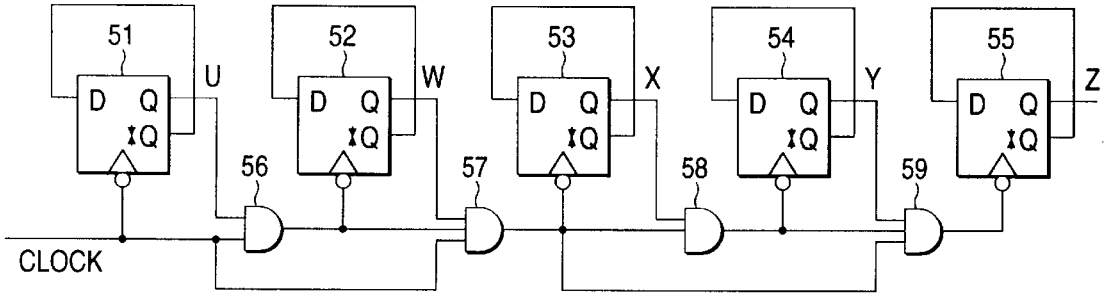
FIG. 10 is a circuit diagram illustrating one example of a binary counter which is asynchronous to the clock signal.

FIG. 10 is a circuit diagram illustrating one example of a binary counter which is asynchronous to the clock signal. In the drawing, reference numerals 51 to 55 designate D flip-flops; and 56 to 59 designate AND circuits. As a representative counter, there are mentioned a Johnson counter, a linear feedback shift register, a binary counter, and a gray code counter. As a result of consideration of the three reasons; namely, 1) the number of blocks is 25=32; 2) the counter should have bidirectionality; and 3) a high timing speed is not required much, the binary counter is advantageous. Although there are a synchronous binary counter and an asynchronous binary counter as the well-known binary counter, the asynchronous binary counter has a simpler circuit configuration and a smaller degree of conductor routing than the synchronous binary counter. However, if an output of a flip-flop in a previous stage is used as a clock signal for the next flip-flop, an output of the next flip-flop will be delayed by one flip-flop. If a five-staged circuit is configured using such a flip-flop, there will arise delays in timing. However, if the synchronous binary counter is used, the number of gates and wires will increase.

In addition to a static master/slave flip-flop which uses one-phase clock, a shift register which has a transmission gate and uses two-phase clock is well known as the D flip-flop. The number of transistors required to configure the shift register that uses two-phase clock is smaller than those required to configure the static master/slave shift register that uses one-phase clock. However, the shift register that uses two-phase clock is very disadvantageous in the case of the circuit which is unclocked by the flip-flop as illustrated in FIG. 10.

The circuit configuration illustrated in FIG. 10 is an asynchronous binary counter which is arranged so as to minimize delays. The D flip-flops 51 to 55 produce inverted outputs on the trailing edge of the clock signal input, and the D flip-flops 51 to 54 output the thus-inverted outputs to the AND circuits 56 to 59. The clock signal entered from outside of the circuit enters the D flip-flop 51 and the AND circuits 56 and 57. The AND circuit 56 outputs an AND result of the output of the D flip-flop 51 and the clock signal, to the D flip-flop 52 and the AND circuit 57. The AND circuit 57 outputs an AND result of the output of the D flip-flop 52, the output of the AND circuit 56, and the clock signal, to the D flip-f lop 53 and the AND circuits 58 and 59. The AND circuit 58 outputs an AND result of the output of the D flip-flop 53 and the AND result output from the AND circuit 57, to the D flip-flop 54 and the AND circuit 59. The AND circuit 59 outputs an AND result of the output of the D flip-flop 54 and the AND results output from the AND circuits 57 and 58, to the D flip-flop 55.

Figure 11:
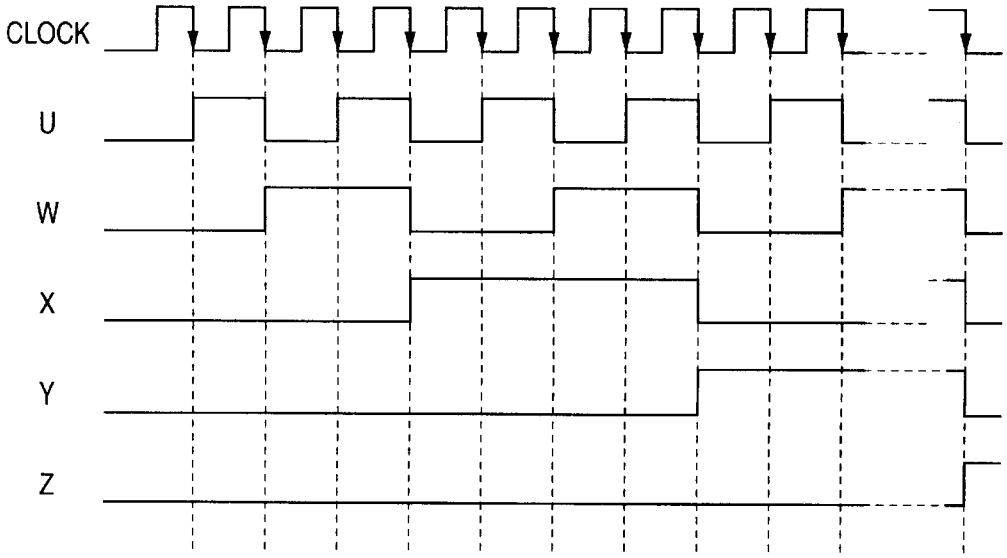
FIG. 11 is a timing chart illustrating one example of operations of the binary counter illustrated in FIG. 10.

FIG. 11 is a timing chart illustrating one example of operations of the binary counter illustrated in FIG. 10. Q outputs of the D flip-flops 51 to 55 are initially low, and *Q outputs which are obtained as a result of reversal of the Q outputs, are connected to D input terminals when they are high. The D flip-flop 51 latches the D input on the first trailing edge of the clock signal and outputs the thus-latched input, whereby signal U becomes high. As a result, one input of the AND circuit 56 becomes high. The output of the D flip-flop 51 is inverted to a low on the trailing edge of the next clock signal. In this way, the output of the D flip-flop 51 is inverted on each trailing edge of the clock signal, thereby resulting in a waveform as represented by the signal U provided in FIG. 11.

Since the signal U is high at the time of the second clock pulse, the second clock pulse directly enters the D flip-flop 52. The output of the D flip-flop 52 is inverted on the trailing edge of the second clock pulse. As a result, the signal W becomes high. The output of the D flip-flop 51 is low at the time of the next third clock pulse, and hence no clock pulse enters the D flip-flop 52 from the AND circuit 56. The output of the D flip-flop 51 is high at the time of the third clock pulse, and hence the fourth clock pulse enters the D flip-flop 52. The output of the D flip-flop 52 is inverted to low on the trailing edge of the fourth clock pulse.

When the output of the D flip-flop 52 becomes high, and when the fourth clock pulse is output from the AND circuit 56, the AND circuit 57 directly outputs the fourth clock pulse received from the AND circuit 56. At this time, since the clock pulse received from the AND circuit 56 is delayed by the AND circuit 56, the leading edge of the clock pulse output from the AND circuit 57 is eventually delayed. However, the trailing edge of the clock pulse output from the AND circuit 57 is directly pursuant to the trailing edge of the clock pulse received from the AND circuit 56, and hence the trailing edge of the clock pulse output from the AND circuit 57 delays by only a delay arising in the AND circuit 57.

The clock pulse output from the AND circuit 57 enters the D flip-flop 53, whereby the output of the D flip-flop 53 is inverted. The D flip-flops 53 and 54 operate in the same way as do the flip-flops 51 and 52 using the clock pulse output from the AND circuit 57 as a clock signal. In this way, signals X and Y as illustrated in FIG. 11 are obtained.

The D flip-flop 55 operates in the same way as do the flip-flops 51 and 53 using the output of an AND circuit 59 as a clock signal. As illustrated in FIG. 11, signal Z which is inverted on the trailing edge of the signal Y, is obtained. Even in this case, the D flip-flop 55 can operate on the trailing edge of the clock pulse output from the AND circuit 57, and hence the output signal of the flip-flop 55 is delayed by the delays arising in the AND circuits 57 and 59. As described above, although the circuit provided in FIG. 10 is an asynchronous binary counter, a delay per clock pulse is much shorter than a delay arising in one flip-flop. The output of the signal Z that delays most, is delayed by only delays arising in two gates.

The thus-obtained signals U, W, X, Y, and Z are clocked signals. It is possible to obtain selection signals corresponding to the blocks by decoding these signals.

If the 4-bit ring counter 7 and the 8-bit ring counter 8 are configured using the binary counter provided in FIG. 10, the 4-bit ring counter 7 is provided with the D flip-flops 51 and 52 and the AND circuits 56 and 57, and the 8-bit ring counter 8 is provided with the D flip-flops 53, 54, and 55 and the AND circuits 58 and 59. It is only necessary to transfer the output of the AND circuit 57 to the 8-bit ring counter 8 from the 4-bit ring counter as a carry signal.

Figure 12:
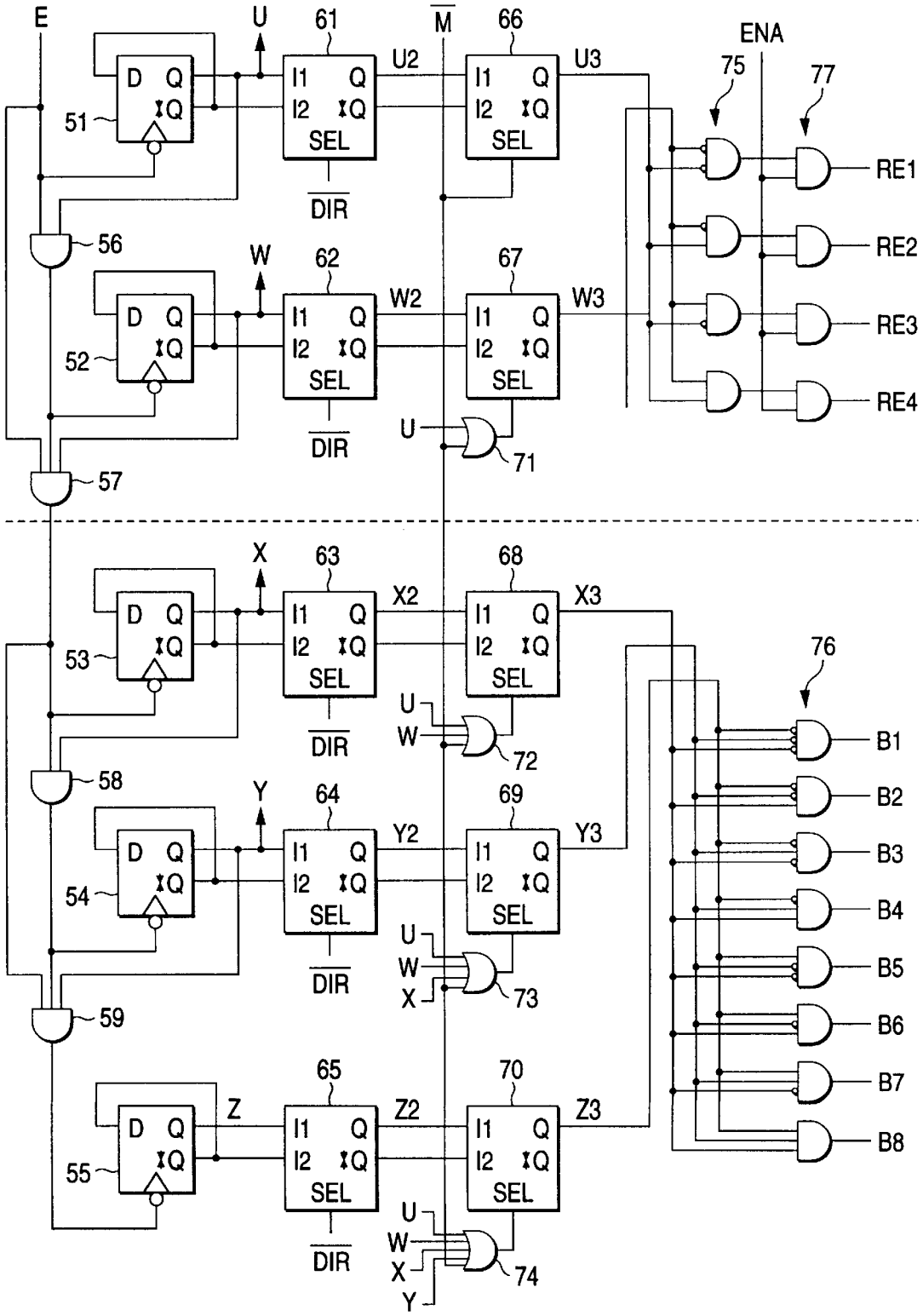
FIG. 12 is a circuit diagram illustrating one example of a 4-bit ring counter and an 8-bit ring counter which use the binary counter provided in FIG. 10.

FIG. 12 is a circuit diagram illustrating one example of the 4-bit ring counter and the 8-bit ring counter which use the binary counter provided in FIG. 10. In the drawing, the elements which are the same as those provided in FIG. 10 are assigned the same reference numerals, and their explanations will be omitted here. Reference numeral 61 to 70 designate selectors; 71 to 74 designate OR circuits; 75 and 76 designate decoding sections; and 77 designates an AND circuit. The block of the circuit above a broken line designates the configuration of the 4-bit ring counter 7, and the block of the circuit below the broken line designates the configuration of the 8-bit ring counter 8. These counters are, in principle, the same in configuration as the binary counter provided in FIG. 10. The outputs of the D flip-flops 51 to 55 are connected to the selectors 61 to 65 and the selectors 66 to 70, and these selectors are further connected to decoding sections 75 and 76. The 4-bit ring counter is further connected to an AND circuit 77.

Although the circuit provided in FIG. 10 is capable of performing only counting-up operations, it may be easily arranged so as to be able to perform countdown. In short, the outputs of the D flip-flops 51 to 55 may be inverted between a forward direction and a reverse direction. To this end, the 4-bit ring counter 7 and the 8-bit ring counter 8 provided in FIG. 12 are provided with the selectors 61 to 65 so as to switch between positive outputs and inverted outputs according to the DIR signal that represents the order in which the blocks are driven. As previously described, the DIR signal designates a forward direction when it is low and designates a reverse direction when it is high. The selectors 61 to 65 select the Q outputs of the D flip-flops 51 to 55 when the inverted DIR signal is high and select *Q outputs which are signals obtained as a result of reversal of the Q outputs, when the inverted DIR signal is low.

In this case, the fact that the pre-pulse and the main pulse differ from each other, presents a problem. More specifically, when the blocks are driven in a forward direction, the block driven by the main pulse is a block one before the block driven by the pre-pulse. To prevent this problem, the circuit is provided with selectors 66 to 70 for use with the main pulse. The outputs of the D flip-flops 51 to 55 are selectively output as the select signal with reference to the pre-pulse. The state in which the outputs must be inverted in order to modify the block to be selected using the main pulse, is calculated by the Quin-McCluskey's method. Then, only the selectors to be inverted are selected so as to produce inverted outputs.

The selectors to be inverted are selected by the OR circuits 71 to 74. If all the lower-order positions of a binary count value are zero, all zeros are inverted together with one which first appears after zeros. The OR circuits 71 to 74 determine whether or not the all the lower-order positions after one, are zeros. For example, if the count value is "00100" in binary notation, the OR circuits 71 and 72 become low at the time of the main pulse drive, whereby the selectors 66 to 68 are inverted. As a result, the count value turns into "00011," and hence a block one before the block driven by the pre-pulse. Even in the case of the driving operations in a reverse order, when the count value is "00100," the selectors 61 to 65 are inverted, whereby the count value becomes "11011." The selectors 66 to 68 are inverted to "11100," and a block one before the block driven by the pre-pulse.

In this way, the number of blocks to be driven at the time of pre-pulse driving operations and the main pulse driving operations are determined. The thus-determined numbers are decoded by the decoding sections 75 and 76, and the thus-decoded data is output to corresponding signal lines as the drive signal.

The 4-bit ring counter 7 calculates an AND result of the output of the decoding section 75 and the ENA signal in the AND circuit section 77, thereby eliminating the necessity of entering the ENABLE signal into the pre-drivers 4. Consequently, the wiring of the circuit is simplified.

The operations of the ink-jet recorder according to one embodiment of the present invention will be described. In summary, bubbles are produced in ink by selectively turning on the drivers 3 so as to cause an electrical current to flow through the heat-generating elements. Ink is squirted by utilization of expansion and contraction of the resultantly produced bubbles, whereby printing operations are carried out. In this example, it is possible to select a maximum number of eight heat-generating elements 2, and the thus-selected heat-generating elements 2 can be pre-heated (can be driven using the pre-pulse) before printing operations. A printing direction and the availability of pre-pulse function can be changed by means of an input signal.

After having received the clear signal (NRST signal), the data retaining circuit 6 serially reads the print data, and the thus-read data is stored in the data retaining circuit 6. The first eight heat-generating elements 2 perform printing operations according to the print data stored in the data retaining circuit 6. The eight heat-generating elements 2 are simultaneously selected every fourth number; for example, 1st, 5th, 9th, 13th, 17th, 21st, 25th, and 29th heat-generating elements (The leftmost heat-generating element is numbered 1st and the rightmost heat-generating element is numbered 256th provided in an upper portion of the circuit diagram provided in FIG. 1 The numbers assigned to the heat-generating elements will be hereinafter referred to as "heat-generating element numbers"). The thus-selected eight heat-generating elements constitute one block. Consequently, it is necessary to rearrange the print data to be sent so as to correspond to the heat-generating elements. During the course of printing operations (during the course of pre-heating of the heat-generating elements carried out during the period of the pre-pulse and during the course of the printing operations carried out during the period of the main pulse, in the case of the double pulse drive), the data retaining circuit 6 reads the print data for the next eight heat-generating elements 2.

The 4-bit ring counter 7 and the 8-bit ring counter 8 select the eight heat-generating elements in order. When the ENABLE signal is high, the 4-bit ring counter 7 drives one of the four output lines high, and the 8-bit ring counter 8 drives one of the eight output lines high. As a result of combination of the four output lines and the eight output lines, any one of the 32 blocks is selected. If high signals are output from the 4-bit ring counter 7 and the 8-bit ring counter 8, eight NAND circuits 5 will be selected. These NAND circuits 5 drive the drivers 3 via the pre-drivers 4 according to the print data latched into the data retaining circuit 6, thereby energizing the heat-generating elements 2. At the time of the single pulse driving operations, printing operations are carried out as a result of energizing of the heat-generating elements 2. In contrast, at the time of the double pulse driving operations, the heat-generating elements 2 are only heated during the period of the pre-pulse, and they are heated during the period of the main pulse. The output of the 4-bit ring counter 7 becomes low on the trailing edge of the ENABLE signal, and the heating of the heat-generating elements 2 is completed. The width of the pre-pulse and the intervals between the pre-pulse and the main pulse which are required at the time of the double pulse driving operations, are controlled by a supplier of the ENABLE signal.

In the case of single pulse driving operations which do not use the pre-pulse, these driving operations are carried out while switching the blocks 32 times for each printing operation. In the case of double pulse driving operations which use the pre-pulse, the driving operations are carried out while switching the blocks 66 times for each pre-heating or printing operation. As a result, the driving of the 256 heat-generating elements 2 is completed. The power is not supplied to the pre-drivers 4 during a low-power consumption mode, which makes it possible to reduce power consumed during nonprinting operations.

The previously-described printing operations will be described in more detail. First, clearing of the entirety of the 4-bit ring counter 7 and the 8-bit ring counter 8, selection of the pre-pulse function, and selection of the printing direction are carried out. The NRST signal is changed from high to low and is changed to high once again. This NRST signal is inverted by a NOT circuit. The D flip-flop 31 of the clock generation circuit 9 provided in FIG. 5 latches the DTDIR signal on the leading edge of the inverted NRST signal. According to the result of logical operations included in the thus-latched DTDIR signal, it is determined whether the double pulse driving operations which use the pre-heating function (i.e., the pre-pulse function) or the single pulse driving operations are carried out. As illustrated in FIGS. 4A and 4B, the double pulse driving operations are selected when the DTDIR signal is low, whereas the single pulse driving operations are selected when the DTDIR signal is high.

As a result of driving the NRST signal low, the 4-bit ring counter 7 and the 8-bit ring counter 8 are cleared. During the period of clearing of the ring counters, the regulator 10 does not supply power to the pre-drivers 4, and the ink-jet recorder enters a less power-consumption mode.

The D latch 11 latches the DTDIR signal on the trailing edge of the inverted NRST signal, and the direction in which the blocks are driven is set. As illustrated in FIGS. 4C and 4D, the direction is set to a forward direction when the DTDIR signal is low and is set to a reverse direction when the DTDIR signal is high.

The clearing of the ring counters and the selection of the driving method and direction are inevitably carried out every time one printing cycle, over which all of the blocks are selected, has been completed. Even at this time, the driving method and direction are selected according to the result of logical operations included in the DTDIR signal on the leading and trailing edges of the NRST signal.

After completion of initialization of the ink-jet recorder, the 4-bit ring counter 7 and the 8-bit ring counter 8 select either the block including the first heat-generating element 2 or the block including the 256th heat-generating element 2 according to the preset driving direction. The double pulse driving operations which use the pre-pulse function, and the single pulse driving operations which does not use the pre-pulse function, will be described separately.

When the double pulse driving operations which use the pre-pulse function are carried out, the pulse of the ENABLE signal is input 66 times during one print cycle. More specifically, the pre-pulse used for pre-heating operations and the main pulse used for ink-squirting operations are alternately input. Of these pulses, ink is not squirted during the period of the first main pulse, and the pre-heating operations are not carried out during the period of the last pre-pulse. The clock generation circuit 7 produces the signals M, E, and ENA from the ENABLE signal. With regard to the signal E, 33 pulses are produced. The pre-pulse formed during the period over which the Nth signal E becomes high, and the main pulse formed during the period over which the N+1th signal E becomes high, select an identical heat-generating element.

To begin with, the block data regarding the first block is read. FIG. 13 is a timing chart used when reading the print data regarding the first block at the time of double pulse driving operations. FIG. 14 is a table illustrating the heat-generating element numbers corresponding to the print data which are read for the first block at the time of double pulse driving operations. As illustrated in FIG. 13, after the NRST signal has become high, the DCLK signal is input eight times until the ENABLE signal is input (or the ENABLE signal becomes high). The DTDIR signal enter the heat-generating elements as the print data, every third number in an ascending order from a small heat-generating element number as illustrated in FIG. 14, on the trailing edge of the DCLK signal. When the high DTDIR signal is read, the heat-generating elements 2 corresponding to the print data are pre-heated by the pre-pulse which follows the DTDIR signal. Then, ink is squirted from the thus-preheated heat-generating elements 2 by the main pulse. After the reading of the print data regarding the first block has been completed, printing operations are carried out according to the print data, and then the print data regarding the next block is read.

FIG. 15 is a timing chart used when print data regarding the Nth block is read at the time of double pulse driving operations. FIG. 16 is a table illustrating the heat-generating element numbers corresponding to the print data which are read for the Nth block when the blocks are driven in a forward direction, at the time of double pulse driving operations. FIG. 17 is a table illustrating the heat-generating element numbers corresponding to the print data which are read for the Nth block when the blocks are driven in a reverse direction, at the time of double pulse driving operations. As illustrated in FIG. 15, the print data regarding the Nth block corresponding to the eight heat-generating elements is serially read into the N−1th segment of the signal E (N=2−32) for pre-heating purposes. The print data read into the signal at this time is read according to the heat-generating element number as provided in FIG. 16 when the blocks are driven in a forward direction. In contrast, when the blocks are driven in a reverse direction, the print data are read according to the heat-generating element number as provided in FIG. 17. At this time, the order in which the heat-generating elements are driven, is set so as to prevent adjoining heat-generating elements from being driven as much as possible. For example, after the group (N=1) which includes the heat-generating element No. 1 has been driven in a forward direction, the group (N=2) which includes the heat-generating element No. 3 is driven.

FIG. 18 is a timing chart regarding the driving operations caused by the pre-pulse and the driving operations caused by the main pulse within an identical block at the time of double pulse driving operations. As designated by hatched areas provided in FIG. 18, the heat-generating elements 2 of the Nth block are pre-heated by the pre-pulse of the Nth segment of the signal E according to the print data read into the N−1th segment of the signal E. Then, the printing operations of the heat-generating elements 2 are carried out by the main pulse of the N+1th segment of the main pulse. In short, the heat-generating elements of the Nth block are pre-heated during the period over which the pre-pulse is high. The printing operations are not performed as a result of heating operations caused not by the main pulse following the pre-pulse but by the hatched main pulse.

For example, where the data retaining circuit 6 having the circuit configuration as provided in FIG. 9 is used, the print data enters the shift register 41 during the period of the N−1th segment of the signal E. The print data that has read into the shift register 41 on the leading edge of the Nth segment of the signal E, is latched into the latch 43. The thus-latched print data is selected by the selector 45 and is used in the pre-pulse driving operations carried out during the Nth segment of the signal E. Simultaneously, the print data is also transferred to the D flip-flop 46. The thus-transferred print data is latched into the D flip-flop 46 on the trailing edge of the Nth segment of the signal E. During the period of this time, driving operations are carried out by the Nth main pulse. Since the print data of the latch 43 is not latched into the D flip-flop 46 at this time, the print data regarding the N−1th block latched into the D flip-flop 46 are output by the selector 45. The print data regarding the Nth block that has been latched into the D flip-flop 46 on the trailing edge of the signal E, is retained during the period over which the N+1th segment of the signal E is high. The thus-retained print data is selected by the selector 45 at the time of the driving operations carried out during the N+1th main pulse, and the thus-selected print data is used in printing operations.

FIG. 19 is a timing chart used when the print data contained in the 32nd segment of the signal E are read at the time of double pulse driving operations. The print data regarding the final block is read into the 31st segment of the signal E. During the period of the 32nd segment of the signal E, the DTDIR signal is constantly held in a low condition, as provided in FIG. 18, and the DCLK signal is input eight times. As a result, the heat-generating elements are prevented from being driven by clearing the print data effected by the final 33rd pre-pulse. The DTDIR and DCLK signals contained in the 33rd segment of the signal E do not affect the printing operations.

FIG. 20 is a table illustrating one example of the operations of the 4-bit ring counter 7 carried out when the blocks are driven in a forward direction as a result of double pulse driving operations. FIG. 21 is a table illustrating one example of the operations of the 8-bit ring counter carried out under the same conditions. In these drawings, E provided at the leftmost position of the top row of the table designates the segment number of the signal E. Pre/Main provided on the right side of E designates a high condition of the pre-pulse or the main pulse contained in the signal E. RE1 to RE4 and B1 to B8 designate the output lines provided in FIG. 1. Blank blocks of the table designate a low condition of the pre-pulse or the main pulse, and only the blocks corresponding to the high pre-pulse or main pulse are designated by H. For example, when driving operations are carried out by the pre-pulse of N=2, the 4-bit ring counter 7 drives RE2 high, and the 8-bit ring counter 8 drives B1 high. Then, the second block is pre-heated. At the time of the main pulse driving operations following the pre-heating operations, the 4-bit ring counter 7 drives RE1 high, and the 8-bit ring counter 8 drives B1 high. Then, printing operations are carried out as a result of the main pulse driving operations of the first block. When driving operations are carried out by the pre-pulse of N=5, the 4-bit ring counter 7 and the 8-bit ring counter 8 drive RE1 and B2 high. Then, the fifth block is pre-heated. At the time of the main pulse driving operations following the pre-heating operations, the 4-bit ring counter 7 drives RE4 high, and the 8-bit ring counter 8 changes the output signal line to B1 and drives B1 high. Then, the fourth block is subjected to main pulse driving operations.

FIG. 22 is a table illustrating one example of operations of the 4-bit ring counter 7 carried out when the blocks are driven in a reverse direction as a result of double pulse driving operations. FIG. 23 is a table illustrating one example of the operations of the 8-bit ring counter carried out under the same conditions. Although there is no substantial difference between forward driving operations and reverse driving operations, if the order in which the blocks are driven in a forward direction is taken as the block number, the number of the block driven by the main pulse as a result of driving operations in a reverse direction will be larger than the number of the block driven by the pre-pulse. For example, when driving operations are carried out by the pre-pulse of N=2, the 4-bit ring counter 7 drives RE3 high, and the 8-bit ring counter 8 drives B8 high. Then, the 31st block is pre-heated. At the time of the main pulse driving operations following the pre-heating operations, the 4-bit ring counter 7 drives RE4 high, and the 8-bit ring counter 8 drives B8 high. Then, printing operations are carried out as a result of the main pulse driving operations of the 32nd block. When driving operations are carried out by the pre-pulse of N=5, the 4-bit ring counter 7 and the 8-bit ring counter 8 drive RE4 and B7 high. Then, the 28th block is pre-heated. At the time of the main pulse driving operations following the pre-heating operations, the 4-bit ring counter 7 drives RE1 high, and the 8-bit ring counter 8 changes the output signal line to B8 and drives B8 high. Then, the 29th block is subjected to main pulse driving operations.

Figure 24:
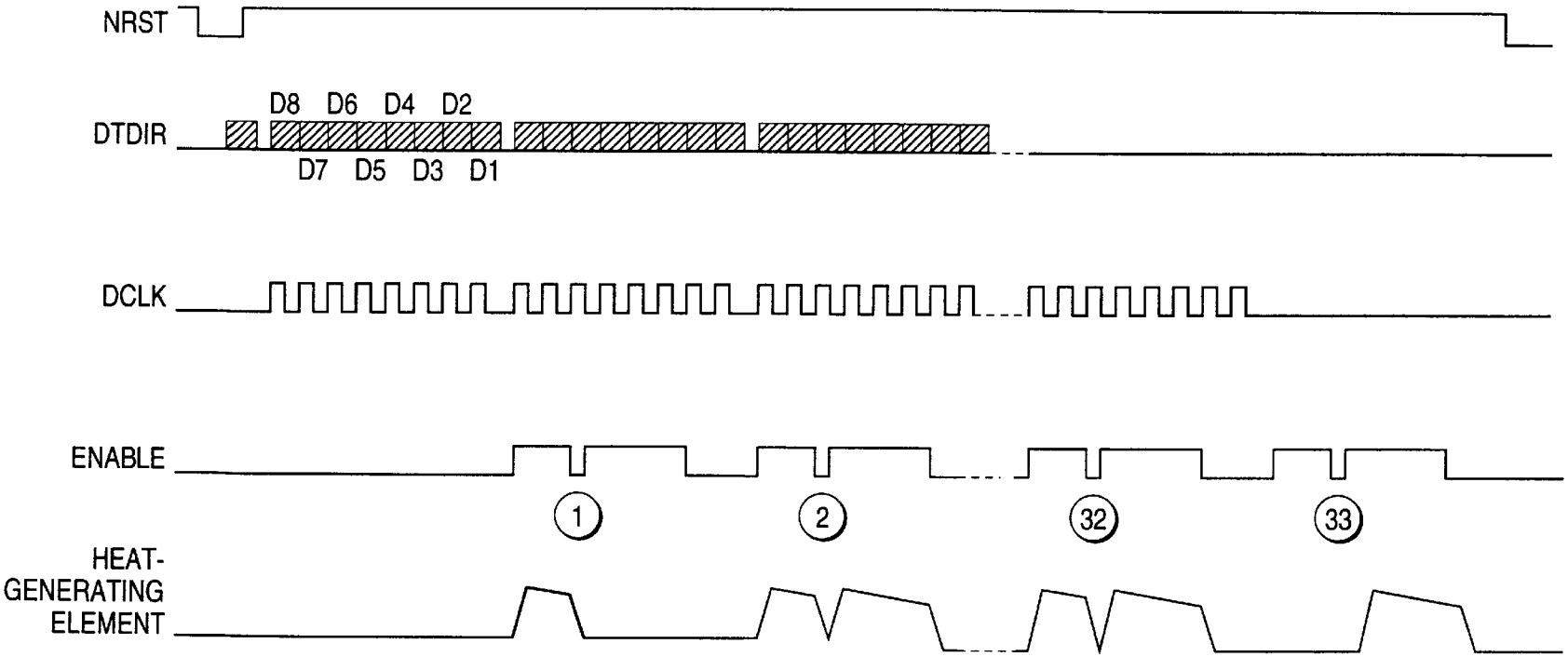
FIG. 24 is a signal sequence illustrating one example of one print cycle at the time of double pulse driving operations.

FIG. 24 is a signal sequence illustrating one example of one print cycle at the time of double pulse driving operations. The previously-described operations will be summarized in the form of the signal sequence as provided in FIG. 24. In short, the DTDIR signal is latched on the leading and trailing edges of the NRST signal, and the driving method and direction are set. The print data corresponding to the first block are read before the first leading edge of the ENABLE signal. Then, the print data corresponding to the N+1th block is read when the Nth block is driven. The print data is reset by driving the DTDIR signal low when the 32nd and 33rd blocks are driven. In contrast, when the first block is driven, only the pre-pulse of the ENABLE signal is used. Then, the heat-generating elements are pre-heated corresponding to the print data regarding the first block. The printing operations are not carried out by the first main pulse. Similarly, when the Nth block is driven, the heat-generating elements are pre-heated by the pre-pulse so as to correspond to the print data regarding the Nth block. Further, the printing operations are carried out by the main pulse so as to correspond to the print data regarding the N−1th block. When the final 33rd block is driven, the block is not driven by the pre-pulse, but the 32nd block is driven by the main pulse.

Nest, one example of printing operations without the pre-pulse function carried out at the time of the single pulse driving operations, will be described. In the case of the single pulse driving operations without the pre-pulse function, the pulse which drives the ENABLE signal high is input 32 times during one cycle. The signal E is equivalent to the ENABLE signal, and the signal M is constantly low. The block to be selected is shifted every time the ENABLE signal pulse is input.

First, the print data regarding the first block is read. FIG. 25 is a timing chart used when the print data regarding the first block is read at the time of the single pulse driving operations. FIG. 26 is a table illustrating the heat-generating element numbers corresponding to the print data which are read for the first block at the time of single pulse driving operations. As illustrated in FIG. 25, after the NRST signal has become high, the DCLK signal is input eight times until the ENABLE signal is input (or the ENABLE signal becomes high). The DTDIR signal enter the heat-generating elements as the print data, every third number in an ascending order from a small heat-generating element number as illustrated in FIG. 26, on the trailing edge of the DCLK signal. When the high DTDIR signal is read, the heat-generating elements 2 corresponding to the print data are pre-heated by the pre-pulse which follows the DTDIR signal. Then, ink is squirted from the thus-preheated heat-generating elements 2 by the main pulse. After the reading of the print data regarding the first block has been completed, printing operations are carried out according to the print data, and then the print data regarding the next block are read.

FIG. 27 is a timing chart used when the print data regarding the Nth block is read at time of single pulse driving operations. FIG. 28 is a table illustrating the heat-generating element numbers corresponding to the print data which are read for the Nth block when the blocks are driven in a forward direction, at the time of single pulse driving operations. FIG. 29 is a table illustrating the heat-generating element numbers corresponding to the print data which are read for the Nth block when the blocks are driven in a reverse direction, at the time of single pulse driving operations. As illustrated in FIG. 27, printing operations are carried out during the period over which the ENABLE signal is high. The print time is determined by the period over which the ENABLE signal is high. The print data is read while the ENABLE signal before the ENABLE signal pulse during which the printing operations are carried out, is high. More specifically, as illustrated in FIG. 27, if the N−1th ENABLE signal is high, the print data regarding the Nth block will be read. In the case of the forward driving operations, the print data is read so as to correspond to the heat-generating element numbers provided in FIG. 28. In contrast, in the case of the reverse driving operations, the print data is read so as to correspond to the heat-generating element numbers provided in FIG. 29.

Figure 30:
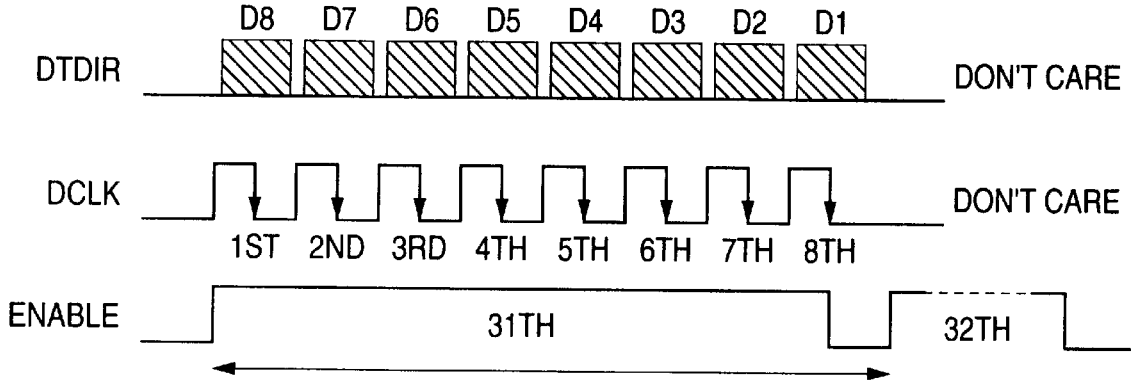
FIG. 30 is a timing chart used when the print data is read into the 31st and 32nd segments of the ENABLE signal at the time of single pulse driving operations.

FIG. 30 is a timing chart used when the print data is read into the 31st and 32nd segments of the ENABLE signal at the time of single pulse driving operations. The print data regarding the thirty-second block is read into the 31st segment of the ENABLE signal. Accordingly, the DCLK and DTDIR signals included in the 32nd ENABLE signal do not affect the printing operations at all.

FIGS. 31A and 31*b* are tables illustrating one example of operations of the 4-bit ring counter 7 carried out at the time of single pulse driving operations. FIGS. 32A and 32B are tables illustrating one example of operations of the 8-bit ring counter 8 carried out at the time of single pulse driving operations. Of the four bits (RE1 to RE4) output from the 4-bit ring counter 7, one bit is high, and the remaining three bits are low. As illustrated in FIG. 31A, the signal line which becomes high is shifted by the ENABLE signal in the order of RE143 RE2→RE3→RE4→RE1→RE2→ . . . on the trailing edge of the ENABLE signal pulse at the time of the forward driving operations. As illustrated in FIG. 31B, the signal line which becomes high is shifted by the ENABLE signal in the order of RE4→RE3→RE2→RE1→RE4→RE3→ . . . at the time of reverse driving operations.

Of the eight bits (B1 to B8) output from the 8-bit ring counter 8, one bit is high, and the remaining seven bits are low. As illustrated in FIG. 32A, the signal line which becomes high is shifted by the ENABLE signal in the order of B1→B2→ . . . →B8 every four trailing edges of the ENABLE signal pulse at the time of the forward driving operations. As illustrated in FIG. 32B, the signal line which becomes high is shifted by the ENABLE signal in the order of B8→B7→ . . . →B1 at the time of reverse driving operations.

Figure 33:
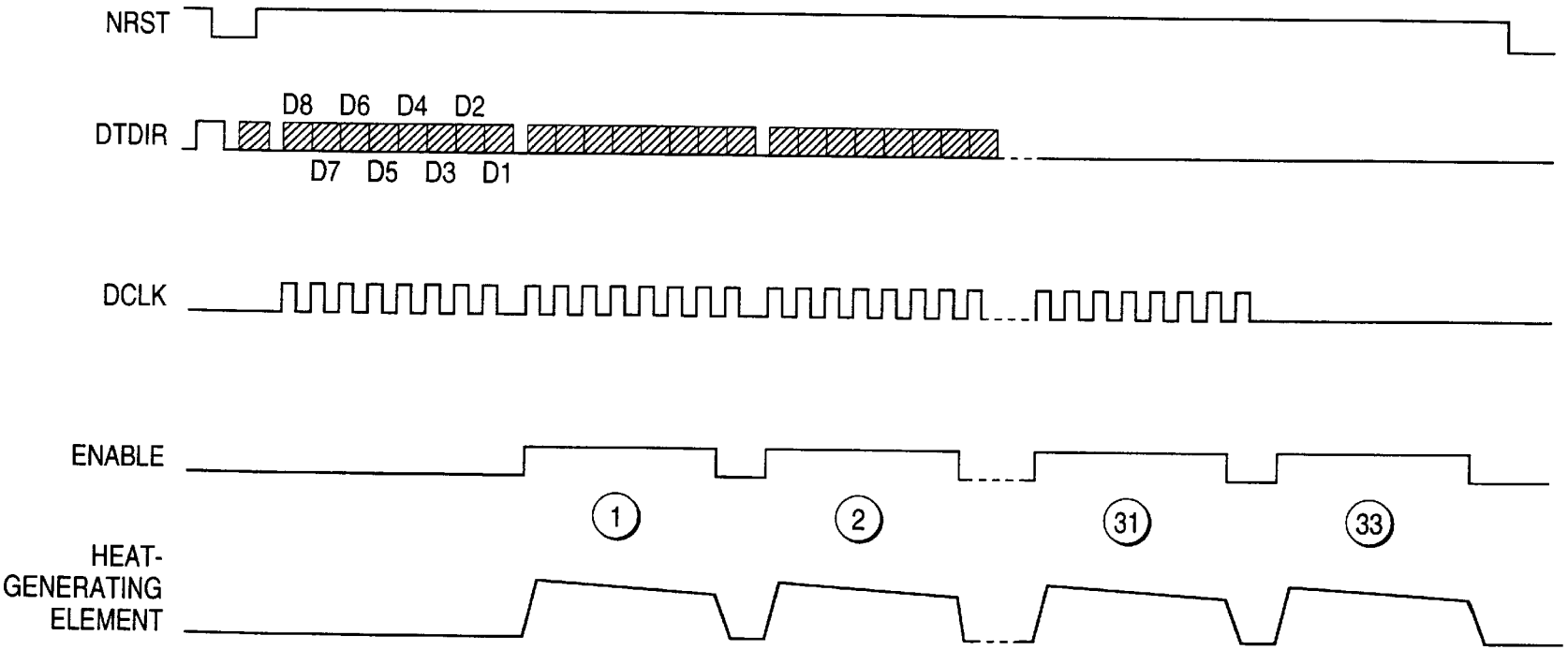
FIG. 33 is a signal sequence illustrating one example of one print cycle at the time of single pulse driving operations.

FIG. 33 is a signal sequence illustrating one example of none print cycle at the time of single pulse driving operations. The previously-described operations will be summarized in the form of the signal sequence as provided in FIG. 33. The DTDIR signal is latched on the leading and trailing edges of the NRST signal, and the driving method and direction are set. The print data corresponding to the first block are read before the first leading edge of the ENABLE signal. Then, the print data corresponding to the N+1th block is read when the Nth block is driven. When the 32nd block is driven, printing operations regarding the print data read when the 31st block is driven, are carried out. Then, the printing operations are completed.

In the foregoing example, the eight heat-generating elements which are selected every fourth number, are simultaneously driven. Four blocks; namely, 32 heat-generating elements, are grouped into one unit, and therefore a total of eight units are shifted one by one. However, the present invention is not limited to this embodiment. For example, continuous eight heat-generating elements can be grouped into one block, or the heat-generating elements can be grouped every other heat-generating element into a block. Further, continuous four heat-generating elements and other continuous four heat-generating elements which are spaced twelve heat-generating elements from each other, may be grouped into one block. Although the continuous thirty-two heat-generating elements are grouped into one unit so as to reduce wires for the signals output from the 8-bit ring counter, the heat-generating elements can be grouped every thirty-one heat-generating elements, thereby resulting in one block being formed from eight heat-generating elements. Further, the order in which the blocks are driven can be arbitrarily changed.

To correspond to an arbitrary order in which the heat-generating elements are driven, the output lines and the input lines of the NAND circuits 5 are arranged into a matrix so as to permit easy input of the output lines of the data retaining circuit 6, the 4-bit ring counter 7, and the 8-bit ring counter 8 (depending on the circuit configuration) into any one of the NAND circuits 5. Therefore, it is possible to change the configuration of the blocks of the heat-generating elements and the driving order by changing only the positions of contact points. At this time, the order in which the print data to be input to the data retaining circuit 6 are arranged, may be changed according to the modified block configuration or driving order.

Although the configuration which permit both the double pulse driving operations and the single pulse driving operations has been described in the previous embodiment, it is possible to reduce the circuit size of the ink-jet recorder by limiting the circuit configuration of the ink-jet recorder only to double pulse driving operations. Further, although both the forward and reverse driving operations are feasible in the previous embodiment, it is possible to reduce the circuit size of the ink-jet recorder by limiting the driving operations to either the forward or reverse driving operation.

Figure 36:
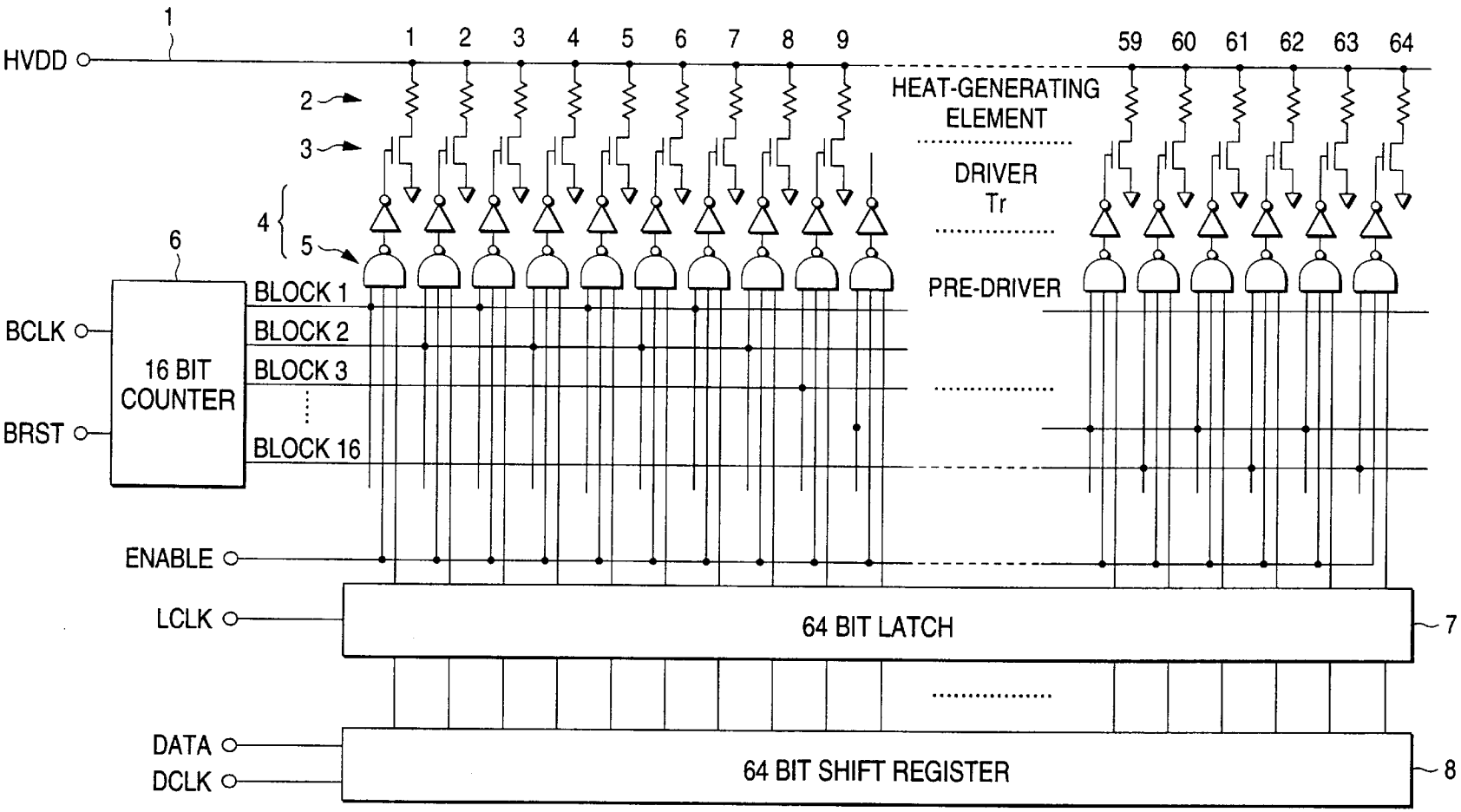
FIG. 36 is a circuit diagram illustrating one example of configuration of a circuit formed on a substrate having heat-generating elements mounted thereon, according to seventeenth embodiment of an ink-jet recorder of the present invention.

FIG. 36 is a circuit diagram illustrating one example of circuitry formed on a substrate having heat-generating elements provided thereon, in an ink-jet recorder according to a seventeenth embodiment of the present invention. In the drawing, the same elements that are provided in FIG. 41 are assigned the same reference numerals, and their explanations will be omitted here. The ink-jet recorder of the present embodiment is basically different from the ink-jet recorder provided in FIG. 41 in that output lines of a 16-bit counter 6 which is a block drive circuit, cross input lines of NAND circuits 5 of all the pre-drivers 4 so as to enable ease of input. More specifically, output lines of the 16-bit counter 6 laterally extend in the drawing, and at least one of the input lines of the NAND circuit 5 of each pre-driver 4 longitudinally extends in the drawing. Each of the input lines is in contact with any one of the output lines. A specific layout of an input section of the pre-driver 4 will be described later with reference to FIGS. 39 and 40. The connection to the input section of the NAND circuit of the pre-driver 4 can be changed by changing only the position of the electrical contact formed between the output lines and the input line.

According to the circuit configuration of the conventional ink-jet recorder which has been described with reference to FIG. 41, adjoining printing operations are carried out between blocks as well as in each block. In contrast, according to the seventeenth embodiment, printing operations are discretely carried out every other character in each block. Among the blocks, the heat-generating elements in odd-numbered blocks 2n−1 (n=1−8) and in even-numbered blocks 2n (n=1−8) are adjacent to each other.

If the previously-described layout is applied to the input section of the pre-driver 4, it becomes possible to flexibly cope with wide-ranging changing of print order; e.g., printing operations carried out every fifteen characters or discrete printing operations carried out on a block-by-block basis, by changing only the position of electrical contact.

Figure 37:
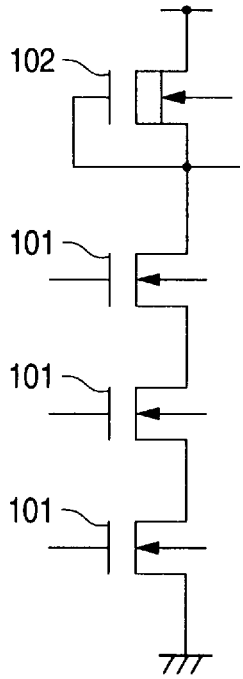
FIG. 37 is a circuit diagram illustrating the inside of an input section of the pre-driver which uses an N-channel ED-MOS circuit configuration.

FIG. 37 is a circuit diagram illustrating the inside of an input section of the pre-driver which uses an N-channel ED-MOS circuit configuration. In the drawing, reference numeral 101 designates an enhanced N-channel drive D-MOS circuit; and 102 designates a depletion N-channel load D-MOS circuit. The input section of the pre-driver 4 is made up of the three-input NAND circuit 5, and an internal circuit of the NAND circuit 5 is illustrated. One load D-MOS circuit 102 and three drive D-MOS circuits 101 are connected in series with the pre-driver source. The gates of the E-MOS circuits 101 serve as input terminals, and a contact point between the load D-MOS circuit 102 and the E-MOS circuits 101 serve as an output terminal. The output terminal goes low only when all the gates of the three E-MOS circuits 101 are high, thereby constituting the NAND circuit.

Figure 38:
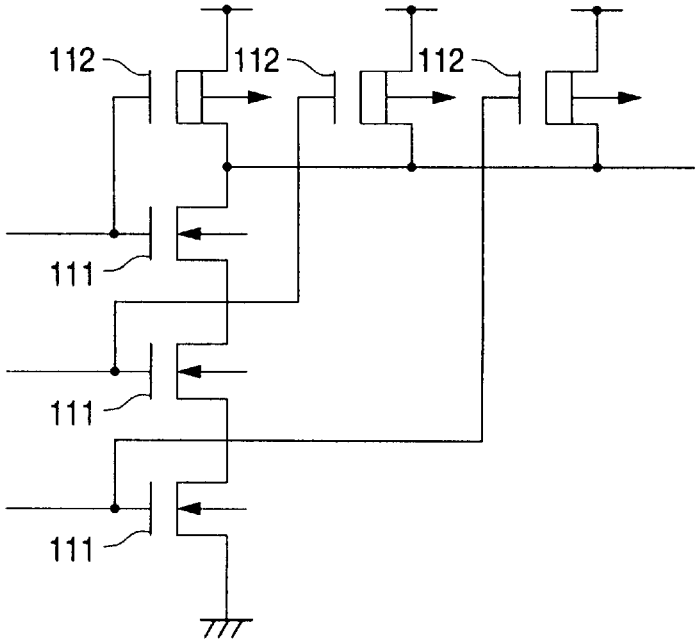
FIG. 38 is a circuit diagram of an internal circuit of the input section of the pre-driver which uses a CMOS circuits.

FIG. 38 is a circuit diagram of an internal circuit of the input section of the pre-driver which uses CMOS circuits and illustrates a second example of the internal circuit of the three-input NAND circuit 5. In the drawing, reference numeral 111 designates an N-channel MOS circuit, and 112 designates a P-channel MOS. The three P-channel MOS circuits 112 are connected in parallel with the power source, and the three N-channel MOS circuits 111 are connected in series to the source. The gate electrode of each of the N-channel MOS circuits 111 serves as an input terminal and is connected to the gate of one P-channel MOS circuit 112. A pair of the N-channel MOS circuit 111 and the P-channel MOS circuit 112 constitute a CMOS circuit. A contact point between the three P-channel MOS circuits 112 and the N-channel MOS circuit 111 serves as an output terminal. The output terminal goes low only when all of the gates of the N-channel MOS circuits 111 become high, thereby constituting a NAND circuit.

Figure 39:
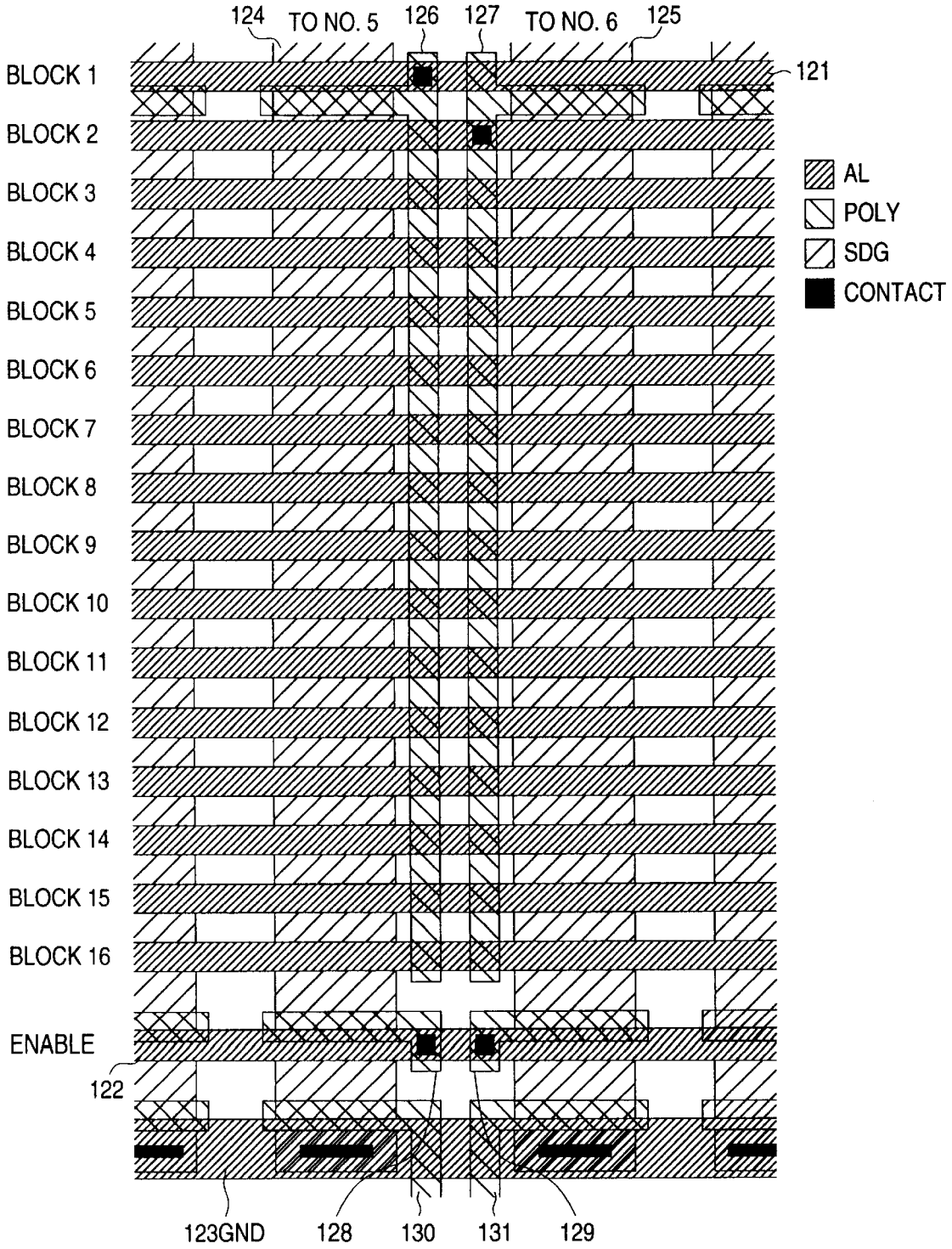
FIG. 39 is a circuit diagram illustrating the first example of a wiring layout of the input section of the pre-driver.

FIG. 39 is a circuit diagram illustrating the first example of a wiring layout of the input section of the pre-driver. Reference numeral 121 designates drive circuit output lines; 122 designates an ENABLE signal output line; 123 designates a ground line; 124 and 125 designate diffused layers; and 126 to 131 designate polysilicon layers. The circuitry formed on the substrate having the heat-generating elements mounted thereon according to the first embodiment provided in FIG. 1B, will now be described. The drawing is a partially-enlarged view of the layout of the input sections of the pre-drivers corresponding to the fifth and sixth heat-generating elements. In the drawing, an aluminum pattern (AL), a polysilicon portion (PL), a diffused layer (SDG), and a contact (CONTACT) are hatched differently. The thus-illustrated layout corresponds to the serially-connected three N-channel E-MOS circuits 101 of the input section of the pre-driver provided in FIG. 22B.

The sixteen drive circuit output lines 121 of a 16-bit ring counter 6, the ENABLE signal output line 122, and the ground line 123 laterally extends in the drawing. Below these lines, the diffused layers 124 and 125 of the NAND circuits 5 of the input sections of the fifth and sixth pre-drivers 4 longitudinally extend in the drawing. Two lines of polysilicon layers 126 and 127 are linearly formed between the longitudinally-formed diffused layers 124 and 125 so as to cross the drive circuit output line 121 of the first block to the drive circuit line 121 of the sixteenth block. The polysilicon layers 126 and 127 have T-shaped branch formed so as to extend between the drive circuit output lines 121 of the first and second blocks and to cover the respective diffused layer 124 and 125, thereby constituting the first N-channel MOS transistor. The polysilicon layers 126 and 127 act as the first gates of the NAND circuits 5.

The drive circuit output line 121 of the first block is connected to the polysilicon layer 126, thereby forming an electrical contact between them. The drive circuit output line 121 of the second block is connected to the polysilicon layer 127, thereby forming an electrical contact between them. As a result, as seen from the circuit diagram provided in FIG. 1B, a drive signal of the block 1 becomes a first input of the fifth NAND circuit 5, and a drive signal of the block 2 becomes the first input of the sixth NAND circuit 5.

Two polysilicon layers 128 and 129 are formed in a downward direction with respect to the two lines of polysilicon layers 126 and 127 in the drawing. The polysilicon layers 128 and 129 are formed into an L-shaped pattern so as to extend between the drive circuit output line of the sixteenth block and the ENABLE signal output line 122 and to cover the respective diffused layers 124 and 125, thereby constituting a second N-channel MOS transistor. The polysilicon layers 126 and 127 serve as the second gates of the NAND circuits 5. The ENABLE signal output line 122 is connected to the polysilicon layers 128 and 129, thereby forming electrical contacts between them.

Further, two polysilicon layers 130 and 131 are formed in a downward direction with respect to the polysilicon layers 128 and 129 in the drawing. The polysilicon layers 130 and 131 are formed into an L-shaped pattern so as to extend between the ENABLE signal output line 122 and the ground line 123 and to cover the respective diffused layers 124 and 125, thereby constituting a third N-channel MOS transistor. The polysilicon layers 130 and 131 serve as the third gates of the NAND circuits 5.

The polysilicon layers 130 and 131 receive latch data from a 64-bit shift register provided in FIG. 36 in a downward area of the circuit diagram omitted from the drawing. The ground line 123 is in contact with the diffused layers 124 and 125. In an upper area of the circuit diagram omitted from the drawing, the drain electrode of the top N-channel E-MOS circuit 101 of the three serially-connected three N-channel E-MOS circuits 101 provided in FIG. 37, is laid over the diffused layers 124 and 125. As a result of contact between the ground line 123 and the diffused layers 124 and 125, the ground line 123 serves as the source electrode of the bottom N-channel E-MOS circuit 101 of the serially-connected three N-channel E-MOS circuits 101.

As a result, as seen from the circuit diagram provided in FIG. 36, the drive signal of the first block becomes the first input of the fifth NAND circuit 5, and the drive signal of the second block becomes the first input of the sixth NAND circuit 5.

The N-channel MOS transistors are formed in the areas; namely, the area between the drive circuit output lines 121 of the first and second blocks; the area between the drive circuit output line 121 of the sixteenth block and the ENABLE signal output line 122; and the area between the ENABLE signal output line 122 and the ground line 123, whereby the layout area of the transistors can be reduced.

Figure 40:
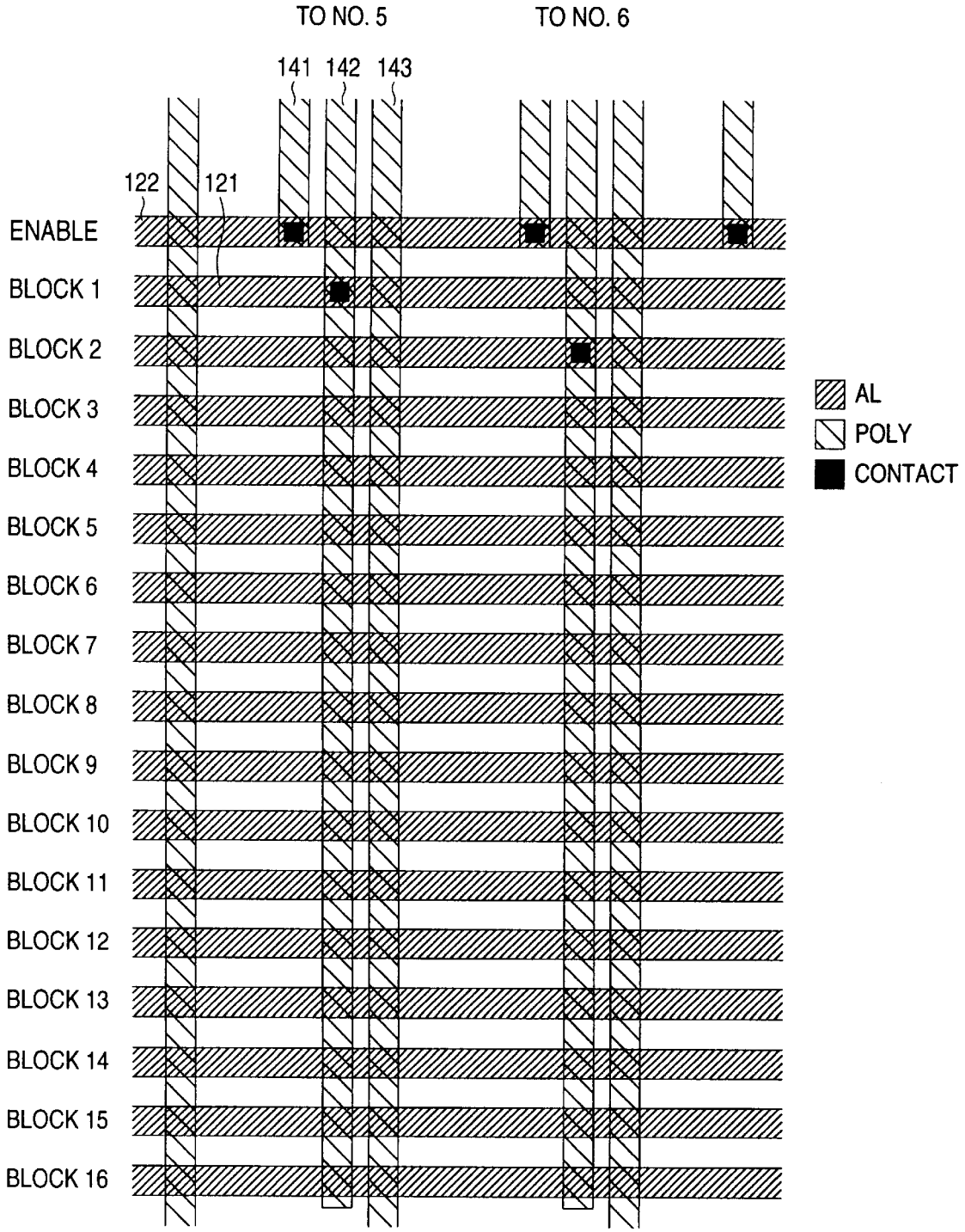
FIG. 40 is a circuit diagram illustrating the second example of a wiring layout of the input section of the pre-driver.
Figure 41:
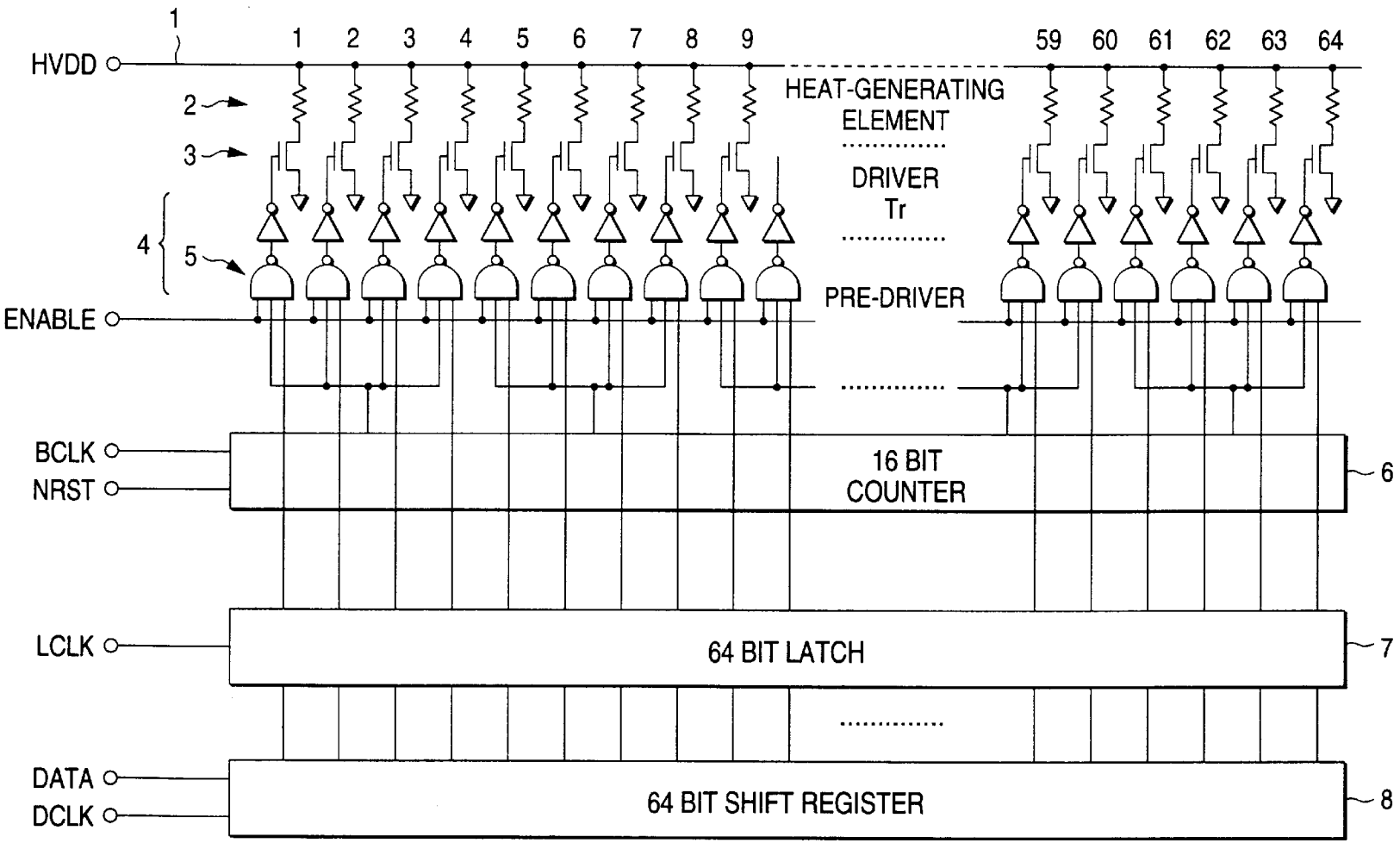
FIG. 41 is a circuit diagram illustrating one example of configuration of a circuit formed on a substrate having heat-generating elements mounted thereon, according to one embodiment of an ink-jet recorder of a conventional art.

FIG. 40 is a circuit diagram of the second example of the wiring layout of the input section of the pre-driver. In the drawings, the elements that are the same as those provided in FIG. 39 are assigned the same reference numerals, and their explanations will be omitted here. Reference numerals 141 to 143 designate polysilicon layers. As in the example provided in FIG. 39, the circuit configuration of the seventeenth embodiment which has been described with reference to FIG. 36, will be described. The circuit layout illustrated in the drawing corresponds to the input line of the serially-connected three E-MOS circuits 101 of the input section of the pre-driver provided in FIG. 37.

The ENABLE signal output line 122 and the sixteen drive circuit output lines 121 of the 16-bit ring counter 6 laterally extend as an aluminum pattern. Below these output lines, the first through third linear polysilicon layers 141 to 143 of the fifth NAND circuit 5 longitudinally extend as the first through third input lines via an insulating layer. Although the first polysilicon layer 141 extends only as far as the ENABLE signal output line 122, the second and third polysilicon layers 142 and 143 extend as far as the output lines 121 of the block 16. Similarly, the three polysilicon layers of the NAND circuit 5 of the other order numbers also longitudinally extend.

The ENABLE signal output line 122 is connected to the first polysilicon layer 141, thereby forming an electrical contact between them. In the lower area of the circuit diagram omitted from the drawing, the latch data output from the 64-bit shift register provided in FIG. 1B enters the third polysilicon layer 143.

The drive circuit output line 121 of the block 1 is connected to the second polysilicon layer 142, thereby forming an electrical contact between them. The drive circuit output line 121 of the second block is connected to the second polysilicon layer of the sixth NAND circuit, thereby forming an electrical contact between them. As a result, as seen from the circuit diagram provided in FIG. 1B, the drive signal of the first block becomes the second input of the fifth NAND circuit 5, and the drive signal of the second block becomes the second input of the sixth NAND circuit 5.

In the upper area of the circuit diagram omitted from the drawing, an input section of the pre-driver which uses the N-channel ED-MOS circuit provided in FIG. 37, or an input section of the pre-driver which uses the CMOS circuit provided in FIG. 38, is formed. The three polysilicon layers 141 to 143 serve as a three-input gate of this pre-driver.

If the input section of the pre-driver has the N-channel ED-MOS circuit as provided in FIG. 37, the circuit layout provided in either FIG. 39 or FIG. 40 can be used. If the input section of the pre-driver has the CMOS circuit as provided in FIG. 38, the circuit layout provided in FIG. 40 can be used. In either of the cases as provided in FIGS. 39 and 40, one of the input gates of the NAND circuit 5 is laid so as to cross all of the block drive signal lines, and hence it is possible to change the signal line to the input section of the pre-driver by changing only the position of an electrical contact between the linear aluminum layer and the linear polysilicon layer. Consequently, it is possible to flexibly cope with wide-ranging changing of print order; e.g., printing operations carried out every fifteen characters or discrete printing operations carried out on a block-by-block basis, by changing only the position of electrical contact.

Therefore, it is possible to flexibly cope with wide-ranging changing of print order; e.g., printing operations carried out every fifteen characters or discrete printing operations carried out on a block-by-block basis, by changing only the position of electrical contact.

Although the previous embodiment has been described using the example of comparatively regular discrete printing operations, it goes without saying that the division of blocks and the heat-generating elements can be configured on a further random basis, and that the order in which blocks are subjected to printing operations can be also changed. It is also possible to easily implement the configuration of an ink-jet recorder in which; e.g., the maximum number of letters capable of being printed is six; discrete printing operations carried out every two characters; the number of blocks is seven, and a total number of heat-generating elements is 146. There is no problem even if the number of heat-generating elements differs from block to block. Further, there is no problem even if the number of the heat-generating elements is a fraction; however, in this case, it is necessary to take into consideration external factors such as a burden on an externally-actuated IC. If the quotient resulting from division of the number of all the heat-generating elements provided on the substrate by the maximum number of characters capable of being simultaneously printed, can be solved into factors, it becomes easy to control the blocks that are printed in a time-dividing manner. The maximum number of characters capable of being simultaneously printed, corresponds to the number of heat-generating elements constituting one block. Further, the quotient resulting from division of the number of all the heat-generating elements by the maximum number of characters capable of being simultaneously printed, corresponds to the number of blocks. Accordingly, if the number of blocks can be solved into factors, it will become easy to control the blocks that are printed in a time-diving manner. Particularly, if the quotient resulting from division of a total number of the heat-generating elements by the maximum number of characters capable of being simultaneously printed, is $2^{nth}$ (N is an integer), the highest efficiency will be obtained. For example, provided that the number of the heat-generating elements is 128, and that the maximum number of characters capable of being simultaneously printed is 8, the highest efficiency will be obtained.

If an attempt is made to configure a substrate having heat-generating elements mounted using N-channel MOS circuits, about fifteen masks will be usually required. If the substrate is formed using CMOS circuits, about twenty masks will be required. Further, if the substrate is formed using bi-CMOS circuits, about twenty-five to thirty masks will be required. According to the prior art, it is necessary to make corrections to nearly all of the masks in order change print order, thereby resulting in an increase in a design period and the costs of masks.

As previously described, the driver is controlled through the pre-driver which merges the outputs from the data retaining circuit and the split-block drive circuit into a single output, so as to permit the outputs of the data retaining circuit and the split-block drive circuit to enter any pre-driver which may receive the outputs. As a result, even if there arises a request of changing print order, the print order can be flexibly changed by changing only the positions of electrical contacts between aluminum and polysilicon without an increase in the area of the substrate having the heat-generating elements mounted thereon. Further, in a case where several chips having their print orders variously changed are prototyped at one time, the design of the chips will be very simplified if they differ from each other in only the positions of electrical contacts.

As is evident from the previous descriptions, the present invention makes it possible to implement a drive circuit which has a simple configuration and performs double pulse driving operations by inserting a pulse for driving another block between a pre-pulse and the main pulse. As a result, a drive circuit is configured in a small size and can be mounted on a substrate having heat-generating elements mounted thereon. Consequently, the substrate can be made compact, which makes it possible to provide a thermal ink-jet recorder having the advantages of cost cutting and high-density packaging. Further, the ink-jet recorder requires only a fewer number of input lines and a smaller degree of wiring routing, which in turn enables mounting of the heat-generating elements on the substrate in a compact way. As described above, the present invention is advantageous in accomplishing a multifunction, high-speed, and high-density recorder, and a circuit can be configured so as to become very compact.

What is claimed is:

1. An ink-jet recorder having an arrangement of a plurality of heat-generating elements, drivers for driving said heat-generating elements, and a drive circuit for controlling said drivers according to image data, said drive circuit comprising:

a split-block drive circuit that divides said plurality of heat-generating elements into a plurality of blocks, and drives said heat-generating elements on a block-by-block basis in a time-sharing manner, the split-block drive circuit generating a pre-pulse and a main pulse; and a data retaining circuit coupled to the split-block drive circuit for retaining print data, said data retaining circuit switching the retained print data according to whether said heat-generating elements are driven by the pre-pulse or the main pulse, said split-block drive circuit:

driving each of said blocks of said heat-generating elements at printing operations, using the pre-pulse during which ink is not squirted and the main pulse during which ink is squirted; and driving another block of heat-generating elements differing from a currently-driven block of heat-generating elements, during intervals between the pre-pulse and the main pulse.

2. The ink-jet recorder of claim 1, wherein said drive circuit receives four signals from outside; which are a print data signal; a clock signal for transferring print data; a drive signal including the pre-pulse and the main pulse; and a reset signal.

3. The ink-jet recorder of claim 2, wherein said drive circuit alternately receives the pre-pulse and the main pulse as the drive signal, and the pre-pulse and the main pulse which are adjoined, are used for driving another block.

4. The ink-jet recorder of claim 2, wherein said drive circuit receives data for use in switching an order in which the blocks are driven, as the print data signal, while receiving the reset signal.

5. The ink-jet recorder of claim 1, wherein said data retaining circuit retains print data having a number which is twice or less as large as the number of said heat-generating elements included in one block.

6. The ink-jet recorder of claim 5, wherein said data retaining circuit includes:

a shift register for sequentially receiving as much print data as the number of heat-generating elements included in one block, a latch circuit for latching the data of said shift register, a delay circuit for delaying the print data by temporarily retaining the print data latched in said latch circuit, and a selection circuit for selecting either the print data latched in said latch circuit or the print data delayed by said delay circuit; and wherein said selection circuit switches according to whether said heat-generating elements are driven by the pre-pulse or the main pulse.

7. The ink-jet recorder of claim 1, wherein said split-block drive circuit includes;

a function of driving said heat-generating elements using a single pulse, and a function of driving said heat-generating elements using two pulses of the pre-pulse and the main pulse, and wherein the functions are switched by means of an input signal sequence.

8. The ink-jet recorder of claim 1, wherein said split-block drive circuit has bidirectionality with regard to an order in which said blocks are driven.

9. The ink-jet recorder of claim 1, wherein said split-block drive circuit has a plurality of counters which are bidirectional with regard to the order in which said blocks are driven, and one block is selected by outputs of said plurality of counters.

10. The ink-jet recorder of claim 9, wherein said split-block drive circuit has arithmetic logic circuits which receive one output from the plurality of counters and one output from said data retaining circuit, so as to respectively correspond said heat-generating elements, and the driver of a corresponding heat-generating element is driven by using the output from said arithmetic logic circuit.

11. The ink-jet recorder of claim 1, wherein said split-block drive circuit has a plurality of counters, and specify one block by means of outputs of said counters;

said counters are asynchronous binary counters each of which has:

a plurality of flip-flop circuits, an AND circuit for receiving outputs from said flip-flop circuits and a clock signal delivered to said flip-flop circuits, wherein an output of said AND circuit enters other flip-flop circuits as a clock signal, and is connected to an input of another AND circuit; and a delay time per stage is shorter than a delay time for one flip-flop circuit.

12. The ink-jet recorder of claim 11, wherein said split-block drive circuit further comprises:

a selection circuit for selecting the outputs; and an inverted output of said flip-flop circuits in an order in which said blocks are driven, so as to enable bidirectional drive of said blocks with regard to the order in which said blocks are driven.

13. The ink-jet recorder of claim 11, wherein said split-block drive circuit further comprises a selection circuit that:

selects one block, drives the thus-selected block using the pre-pulse, and then selects said block having already been driven by the pre-pulse before said thus-driven block, in order to drive said thus-selected block using the main pulse.

14. The ink-jet recorder of claim 11, wherein said split-block drive circuit has arithmetic logic circuits which receive one output from the plurality of counters and one output from said data retaining circuit, so as to respectively correspond said heat-generating elements, and the driver of a corresponding heat-generating element is driven by using the output from said arithmetic logic circuit.

15. The ink-jet recorder of claim 1, wherein:

a pre-driver section for synthetically boosting the output of a low-voltage logic element provided in said drive circuit, and a regulator circuit for supplying power to the pre-driver section, are interposed between said drivers and said drive circuit; wherein said regulator circuit feeds power to the pre-driver section from said common electrode for use with said heat-generating elements and has a standby mode in which power is not supplied to the pre-driver in response to the input signal.

16. The ink-jet recorder of claim 1, wherein said heat-generating elements are formed from polysilicon, and said driver is formed from a MOS transistor.

17. The ink-jet recorder of claim 1, further comprising:

a first test terminal for outputting a part of a block selection signal output from said split-block drive circuit, and a second test terminal for outputting at least a part of data signal output from said data retaining circuit.

18. An ink-jet recording head which includes a substrate having mounted thereon, the substrate comprising:

a plurality of heat-generating elements for applying thermal energy to ink, a driver for driving said heat-generating elements, and a drive circuit for controlling said driver according to image data, wherein a split-block drive circuit that divides the plurality of heat-generating elements into a plurality of blocks and drives said heat-generating elements on a block-by-block basis in a time-sharing manner the split-block drive circuit generating a pre-pulse and a main pulse;

a data retaining circuit coupled to the split-block drive circuit for retaining print data, said data retaining circuit switching the retained print data according to whether said heat-generating elements are driven by the pre-pulse or the main pulse; and input lines of the drive circuit which correspond to the plurality of heat-generating elements, the input lines being routed on the substrate so as to cross at least one of block drive lines of the split-block driving circuit, the block drive line being interconnected to the input lines at an intersection between them.

19. The ink-jet recording head of claim 18, wherein a quotient resulting from dividing a total number of said heat-generating elements on said substrate by a maximum number of characters capable of being simultaneously printed can be solved into factors.

* * * * *